US012422148B1

(12) United States Patent
Chandler, Jr.

(10) Patent No.: US 12,422,148 B1
(45) Date of Patent: Sep. 23, 2025

(54) WATER HEATER SYSTEM

(71) Applicant: Chandler Systems, Inc., Ashland, OH (US)

(72) Inventor: William D. Chandler, Jr., Ashland, OH (US)

( * ) Notice: Subject to any disclaimer, the term of this patent is extended or adjusted under 35 U.S.C. 154(b) by 929 days.

(21) Appl. No.: 17/522,472

(22) Filed: Nov. 9, 2021

Related U.S. Application Data

(60) Provisional application No. 63/115,644, filed on Nov. 19, 2020.

(51) Int. Cl.
*F24D 17/00* (2022.01)
*F24H 15/31* (2022.01)

(52) U.S. Cl.
CPC ..... *F24D 17/0036* (2013.01); *F24H 15/31* (2022.01); *F24D 2200/32* (2013.01)

(58) Field of Classification Search
CPC ..... F24D 17/00; F24D 17/0015; F24D 17/0021; F24D 17/0026; F24D 17/0031; F24D 17/0036; F24D 17/0042; F24D 17/0047; F24D 17/0063; F24D 17/0068; F24D 15/00; F24D 15/108; F24D 15/16; F24D 15/164; F24D 15/168; F24D 15/174; F24D 15/212; F24D 15/215; F24D 15/30; F24D 15/31; F24D 15/355; F24D 15/37; F24D 2200/32
USPC ..... 392/341
See application file for complete search history.

(56) References Cited

U.S. PATENT DOCUMENTS 4,121,079 A * 10/1978 Harmon ..... H05B 6/666 219/718
5,979,776 A * 11/1999 Williams ..... G05D 23/1393 236/12.12
6,194,793 B1 * 2/2001 Fisher, Jr. ..... H02J 7/35 307/66
7,020,387 B1 * 3/2006 Andrakin ..... F24H 1/10 429/900
7,046,922 B1 * 5/2006 Sturm ..... F24H 15/219 392/482
9,234,664 B1 * 1/2016 Hayner ..... F24H 9/2021
2006/0232133 A1 * 10/2006 Cha ..... H02J 9/062 307/23
2011/0304295 A1 * 12/2011 McNally ..... H02J 7/34 320/101

(Continued)

*Primary Examiner* — Sang Y Paik
(74) *Attorney, Agent, or Firm* — Ralph E. Jocke; WALKER & JOCKE

(57) ABSTRACT

An on-demand water heater (12) includes a heat exchanger (25). Water is supplied to the water heater from a water source such as a well pump (16) or other source of water. The water supplied to the water heater is treated by at least one water conditioner 18. A plurality of electrical heating elements (26, 28, 30, 32) are supplied with electrical power from rechargeable battery pack (46). At least one circuit (48) is operative to control the delivery electrical power from the battery pack to the heating elements to provide for the delivery of heated water at a set temperature from the water heater. The battery pack of the water heater is recharged from an available supply of house current electrical power. The rechargeable battery pack of the exemplary water heater also provides an auxiliary source of electrical power for other devices in circumstances when electrical power from a usual supply source becomes unavailable.

27 Claims, 12 Drawing Sheets

(56) References Cited

U.S. PATENT DOCUMENTS

| | | | | |
|---|---|---|---|---|
| 2013/0034344 | A1* | 2/2013 | Lutz | F24H 15/486<br>392/449 |
| 2013/0266295 | A1* | 10/2013 | Kreutzman | F24D 19/1006<br>392/308 |
| 2015/0022001 | A1* | 1/2015 | Goei | H02J 7/0068<br>307/65 |
| 2017/0059172 | A1* | 3/2017 | Johnson | H05B 1/0263 |
| 2019/0045980 | A1* | 2/2019 | Yu | F16K 31/02 |
| 2019/0170398 | A1* | 6/2019 | Chaudhry | G05D 23/19 |
| 2021/0270471 | A1* | 9/2021 | Hayden | G05B 15/02 |

* cited by examiner

WATER HEATER SYSTEM

TECHNICAL FIELD

Exemplary arrangements relate to an on-demand water heater system that provides heated water for use in residential or commercial building environments.

BACKGROUND

Residential and commercial buildings typically require the availability of heated water for delivery to water use devices. Such water use devices may include sinks, showers, bathtubs, clothes washers, dish washers and other types of water use devices that require heated water for proper operation.

Some types of water heaters include a storage tank that houses water. A heater operates to heat the water in the tank. The heated water in the tank is supplied through suitable conduits to the water use devices. The water in the tank may be heated by a burner that operates to combust a fossil fuel to produce heat that is transferred to the water held in the tank. Other types of tank type water heaters may use electrical heating elements to produce heat that is transferred to the water in the tank.

On-demand type water heaters do not utilize a water holding tank. Water that passes through a heat exchanger is heated to a suitable level for use by water use devices. On-demand water heaters commonly use at least one burner that combusts fossil fuel for purposes of supplying heat to the heat exchanger.

Water heaters may benefit from improvements.

SUMMARY

Exemplary arrangements comprise a water heater system that includes an on-demand water heater. The on-demand water heater operates to supply hot water to water use devices in a residential or commercial facility.

The exemplary arrangement includes an on-demand water heater that includes a heat exchanger. The heat exchanger includes a heat exchanger inlet and a heat exchanger outlet. In exemplary arrangements a water inlet temperature sensor is operative to sense a temperature corresponding to the temperature of water entering the heat exchanger inlet. A water outlet temperature sensor is operative to sense a temperature corresponding to the temperature of water exiting the heat exchanger outlet. A flowmeter is in operative fluid connection with the heat exchanger. The flowmeter is operative to sense a water flow rate corresponding to the rate of water flow through the heat exchanger.

At least one electrical heating element is in thermal connection with the heat exchanger. A rechargeable battery pack is in operative connection with the at least one electrical heating element.

At least one circuit is in operative connection with at least one data store. The at least one data store includes data corresponding to a set hot water delivery temperature. The at least one circuit is in operative connection with the at least one electrical heating element, the water inlet temperature sensor, the water outlet temperature sensor, the flowmeter, and the rechargeable battery pack. The at least one circuit is also in operative connection with a house current electrical connector.

The exemplary at least one circuit is operative to cause the rechargeable battery pack to be charged responsive at least in part to electrical power delivered through the house current electrical connector. The house current electrical connector is limited to supplying power below a set power level. In exemplary arrangements a set power level is a power level that is comparable to electrical power used by other electrically powered devices in the residential or commercial facility in which the system is installed.

The exemplary at least one circuit is further operative responsive at least in part to water flow at a rate sensed through operation of the flowmeter, and water temperature sensed by at least one water temperature sensor, to cause power to be delivered to the at least one heating element from the rechargeable battery pack. The power delivered to the at least one heating element is operative to cause the water delivered from the heat exchanger outlet to be at about the set water outlet temperature. In exemplary arrangements power is delivered from the rechargeable battery pack at a battery power pack delivery rate that is much higher than the set power level that can be delivered through the source of house current electrical power that is used to charge the battery pack.

Exemplary arrangements further provide capabilities for the on-demand water heater to be operated in connection with a water management system within the facility. The water management system includes a water conditioner that is operative to provide treated water to the water heater, as well as to perform numerous other functions that facilitate the delivery of water within the facility.

Further in other exemplary arrangements the at least one circuit may be operative to enable the rechargeable battery pack to deliver electrical power that enables the operation of other devices in circumstances where a supply source, such as power delivered by an electric utility, becomes unavailable. Further other exemplary arrangements enable the on-demand water heater to be integrated with other alternative energy sources such as solar panels, wind turbine electric generators or an integrated facility battery power supply system. Numerous different features and devices may be utilized in connection with exemplary arrangements.

DETAILED DESCRIPTION

Figure 1:
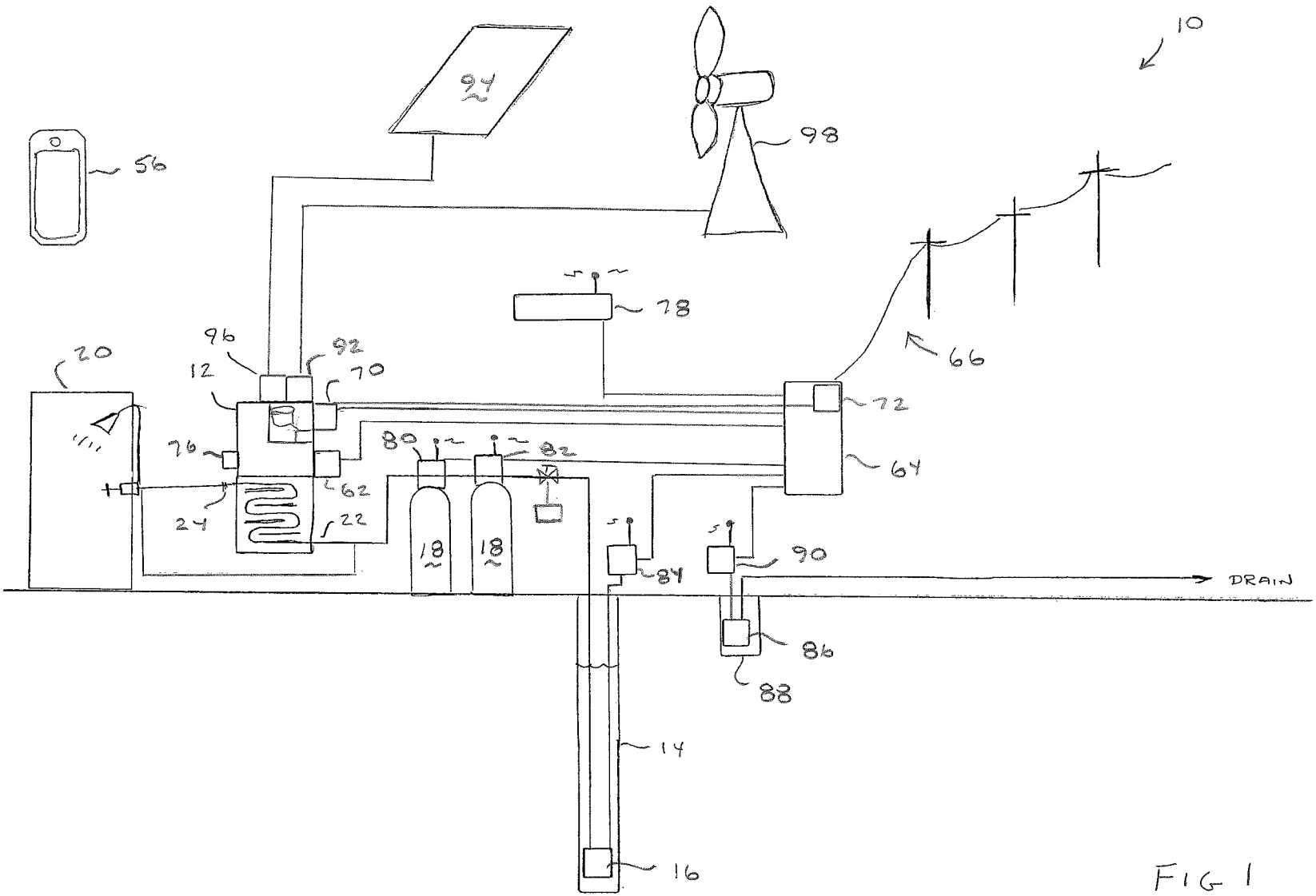
FIG. 1 is a schematic view of an exemplary on-demand water heater system.

Referring now to the drawings and particularly to FIG. 1 there is shown therein an exemplary on-demand water heater system schematically indicated 10. The exemplary system includes an on-demand water heater 12. For purposes of this disclosure an on-demand water heater shall be defined as a water heater that does not include a hot water holding tank. The water heater is configured to be connected to a source of water. The source of water may include a water supply line of a public utility, a lake, a reservoir, a holding tank or other water source. In the exemplary arrangement shown, the source of water includes a well 14. A well pump 16 is operative to deliver water from the well. In the exemplary arrangement water from the well 14 is passed through at least one water conditioner 18. In the exemplary arrangement the at least one water conditioner is operative to at least one of filter, soften, treat or otherwise adjust the properties of the supplied water so as to be more suitable for use in the residential or commercial facility in which the water is used. Exemplary arrangements may include features such as those described in U.S. Pat. No. 10,829,388 which is incorporated herein by reference in its entirety.

In the exemplary system the treated water that has passed through the at least one water conditioner 18 is delivered to a water distribution system within the facility. Exemplary systems may also include valve arrangements that operate in a manner like that described in the incorporated disclosure. The water distribution system includes at least one water use device. Such water use devices commonly include sinks, bathtubs, showers, clothes washers, dish washers and other devices in which hot water is delivered and/or used. In FIG. 1 a shower 20 is shown as a representative water use device. The water that has been treated by the at least one water conditioner is delivered to an inlet 22 of the water heater 12. Heated water from the water heater is passed from an outlet 24 to the one or more water use devices. Of course it should be understood that this arrangement is exemplary and in other arrangements other approaches may be used.

Figure 2:
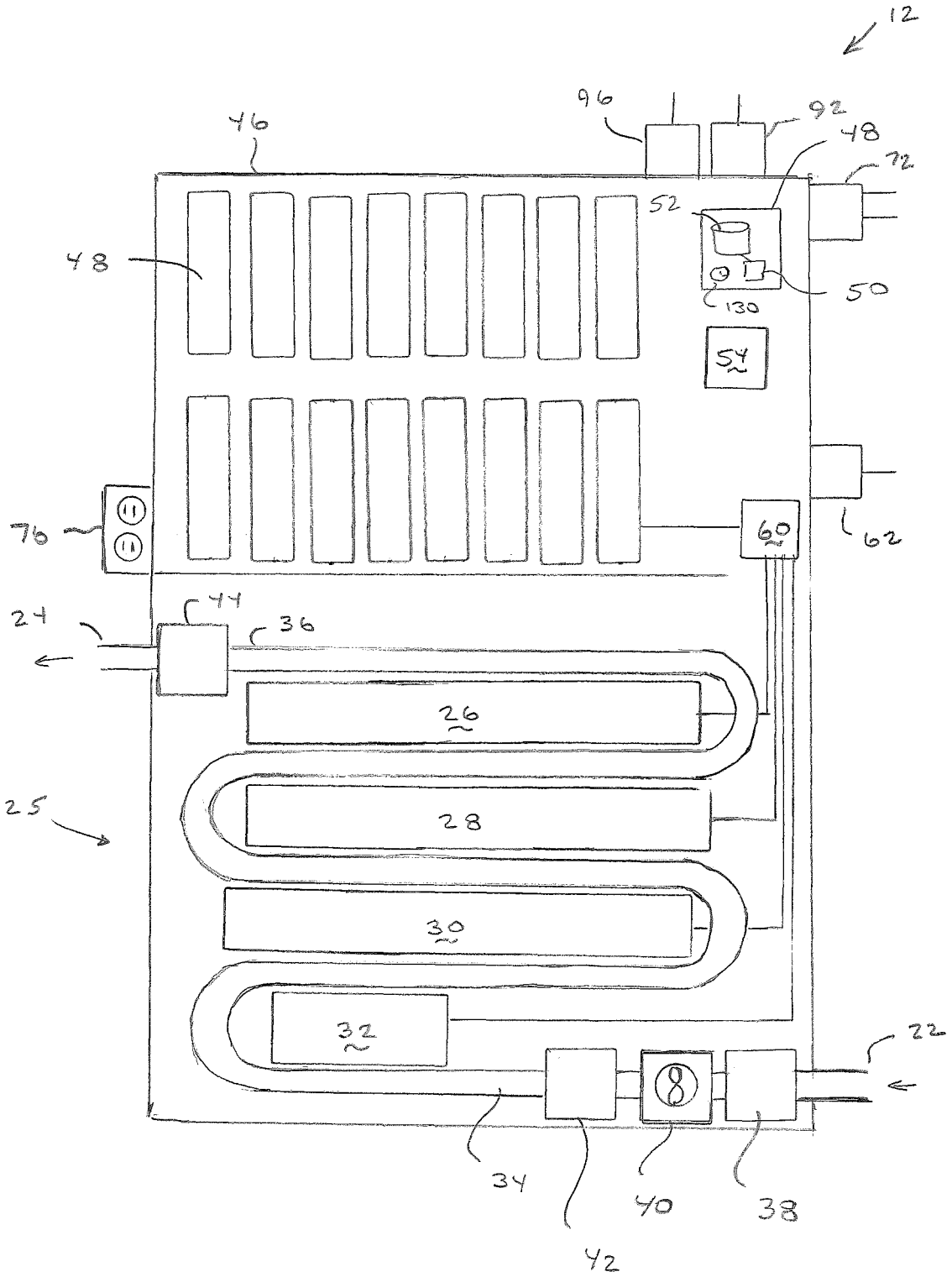
FIG. 2 is a schematic view of an exemplary on-demand water heater.

As shown in greater detail in FIG. 2, the exemplary water heater 12 includes a heat exchanger 25. The exemplary heat exchanger is a closed tube type heat exchanger which is in operative thermal connection with a plurality of electrical heating elements 26, 28, 30 and 32. The electrical heating elements may include any type of heating element that is operative to convert electrical energy into heat energy, Examples of such heaters include resistance type heating elements, ceramic heating elements, semiconductor heating elements, thin film heating elements and polymer PTC heating elements. The heat exchanger 25 includes a heat exchanger inlet 34 that is in operative fluid connection with the inlet 22 and the water source. A heat exchanger outlet 36 is in operative fluid connection with the unit outlet 24 and the water use devices.

In the exemplary arrangement a water inlet temperature sensor 38 is positioned in operative connection with the heat exchanger inlet 34. The water inlet temperature sensor 38 is configured to sense a temperature corresponding to the temperature of water entering the heat exchanger inlet 34. A flowmeter 40 is in operative fluid connection with the heat exchanger inlet 34. The flowmeter 40, which may be of the type described in the incorporated disclosure, is operative to sense a water flow rate corresponding to the rate of water flow that is passing through the heat exchanger at a current time. In the exemplary arrangement the water heater 12 further includes a flow control valve 42. The exemplary flow control valve is selectively operative to control the flow rate of water through the heat exchanger. In exemplary arrangements the flow control valve 42 may be operative to selectively entirely stop flow through the heat exchanger as well as to provide flow through the heat exchanger within a range of selected flow rates. Of course it should be understood that these devices are exemplary and other arrangements other devices and approaches may be used.

The exemplary heat exchanger further includes a water outlet temperature sensor 44. The exemplary water outlet temperature sensor is operative to sense temperature corresponding to temperature of water leaving the heat exchanger through the heat exchanger outlet 36. It should be understood that while in the exemplary arrangement a water inlet temperature sensor and a water outlet temperature sensor are utilized, in other exemplary arrangements other numbers and types of temperature sensing devices may be used. These may include one or more temperature sensors that sense a temperature that is external of the water heater. Alternatively or in addition, temperature sensors may be provided at other locations within or outside the heat exchanger and/or the water heater. It should be understood that at least one temperature sensor may be utilized in various arrangements to determine water temperature corresponding to at least one temperature of water in at least one location within the heat exchanger. Such an at least one sensor may be usable in exemplary arrangements because in such arrangements data received by the at least one circuit corresponding to a water temperature at a given point in the system enables the calculation of the approximate water temperature at other points in the system based on the temperature at the point where the temperature is detected and other factors such as the amount of heat added to the water through the heating elements connected to the heat exchanger, the rate of water flow, and other known factors. Of course it should be understood that these approaches are exemplary of approaches that may be used.

The exemplary water heater 12 further includes a rechargeable battery pack 46. The exemplary battery pack includes a plurality of battery cells 48 which are electrically connected. Such exemplary battery cells may include lithium-ion type cells or other suitable battery cells that produce electrical energy sufficient to power the electrical heating elements and heat the water that passes through the heat exchanger 25. In exemplary arrangements the rechargeable battery pack is operative to supply sufficient electrical power at an electrical power delivery rate that is operative to heat the electrical heating elements to a sufficient temperature that is operative to heat the water passing through the heat exchanger to a desired set temperature at the heat exchanger outlet. In exemplary arrangements the power delivery rate from the rechargeable battery pack to the electrical heating elements is sufficient so that the water that is supplied from the water source to the water heater at an initial temperature can be heated to about the desired set temperature at all flow rates within the rated flow capacity of the water heater. Of course this approach is exemplary and in other arrangements other approaches may be used.

The exemplary water heater is in operative connection with at least one circuit 48. The at least one circuit is operative to communicate electrical signals with other devices and to control the operation of the electric heating elements and other devices as discussed herein. In the exemplary arrangement the at least one circuit includes a processor schematically indicated 50 that is in operative connection with at least one data store 52. In exemplary arrangements the processor is suitable for carrying out circuit executable instructions that are stored in the at least one data store. The processor includes or is in operative connection with a nonvolatile storage medium including instructions that include a basic input/output system (BIOS). For example, the processor may correspond to one or more or combination of a CPU, FPGA, ASIC or other integrated circuit or other type of circuit that is capable of processing data and instructions.

The one or more data stores may correspond to one or more of volatile or nonvolatile memories such as random access memory, flash memory, magnetic memory, optical memory, solid-state memory or other devices that are operative to store processor executable instructions and data. Processor executable instructions may include instructions in any of a plurality of programming languages and formats including, without limitation, routines, subroutines, programs, threads of execution, objects, scripts, methodologies and functions which are usable to carry out the actions that are described herein. The structures for processors may include, correspond to and utilize the principles described in the textbook entitled Microprocessor Architecture, Programming and Applications with the 8085 by Ramesh S. Gaonker (Penham International Publishing 2013) which is incorporated herein by reference in its entirety.

The exemplary arrangements may include for example, circuitry that has processors produced by Intel Corporation, Advanced Micro Devices or other manufacturers of suitable processors. Exemplary data stores used in connection with exemplary circuits may include any one or more of several types of mediums suitable for holding computer executable instructions and data. These may include for example, magnetic media, optical media, solid-state media or other types of media such as RAM, ROM, PROMs, flash memory, computer hard drives, solid-state drives or any other form of media suitable for holding data and circuit executable instructions. Exemplary circuitry may include other components such as hardware and/or software interfaces for communication with other devices and systems. Further it should be understood that while in the exemplary arrangement the at least one circuit is located within the water heater 12, in other exemplary arrangements the at least one circuit or portions thereof may be located remotely from the water heater.

The exemplary water heater 12 is further in operative connection with a controller schematically indicated 54. In exemplary arrangements the controller 54 may be a slave controller of the type discussed in the incorporated disclosure which is operative to communicate with a master controller. Alternatively in other exemplary arrangements the controller 54 may include the capabilities of a master controller of the type discussed in the incorporated disclosure. Such a controller may include the capabilities for communicating with and controlling other devices that are in operative connection with the water heater. Further in some exemplary arrangements the controller may be operative to communicate with a user portable wireless devices 56. Such user portable wireless devices may include devices such as a smart phone, a tablet, a laptop computer or other device which provides a portable user interface.

Figure 3:
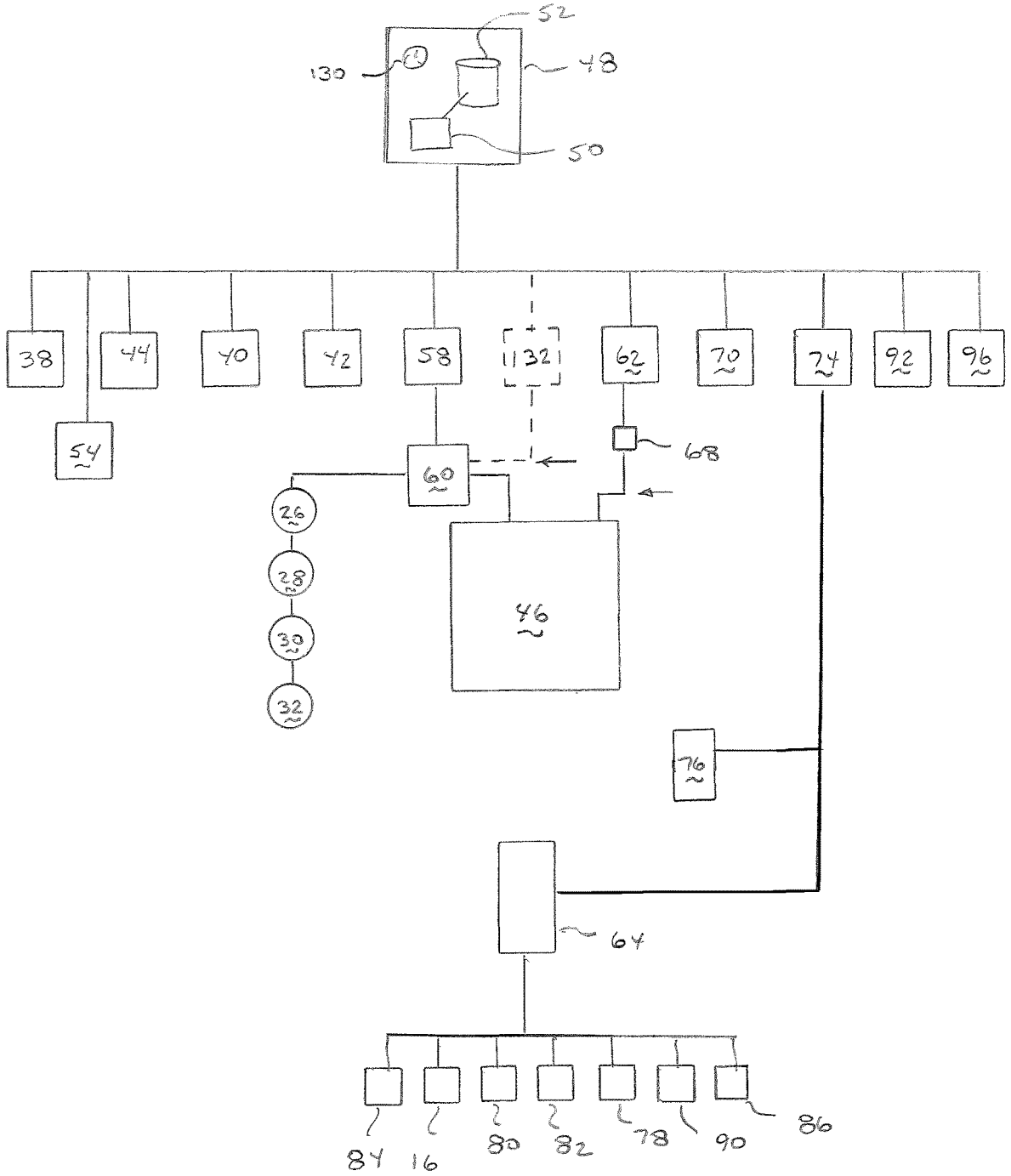
FIG. 3 is a schematic view of circuitry associated with the exemplary on-demand water heater system shown in FIG. 1.
Figure 4:
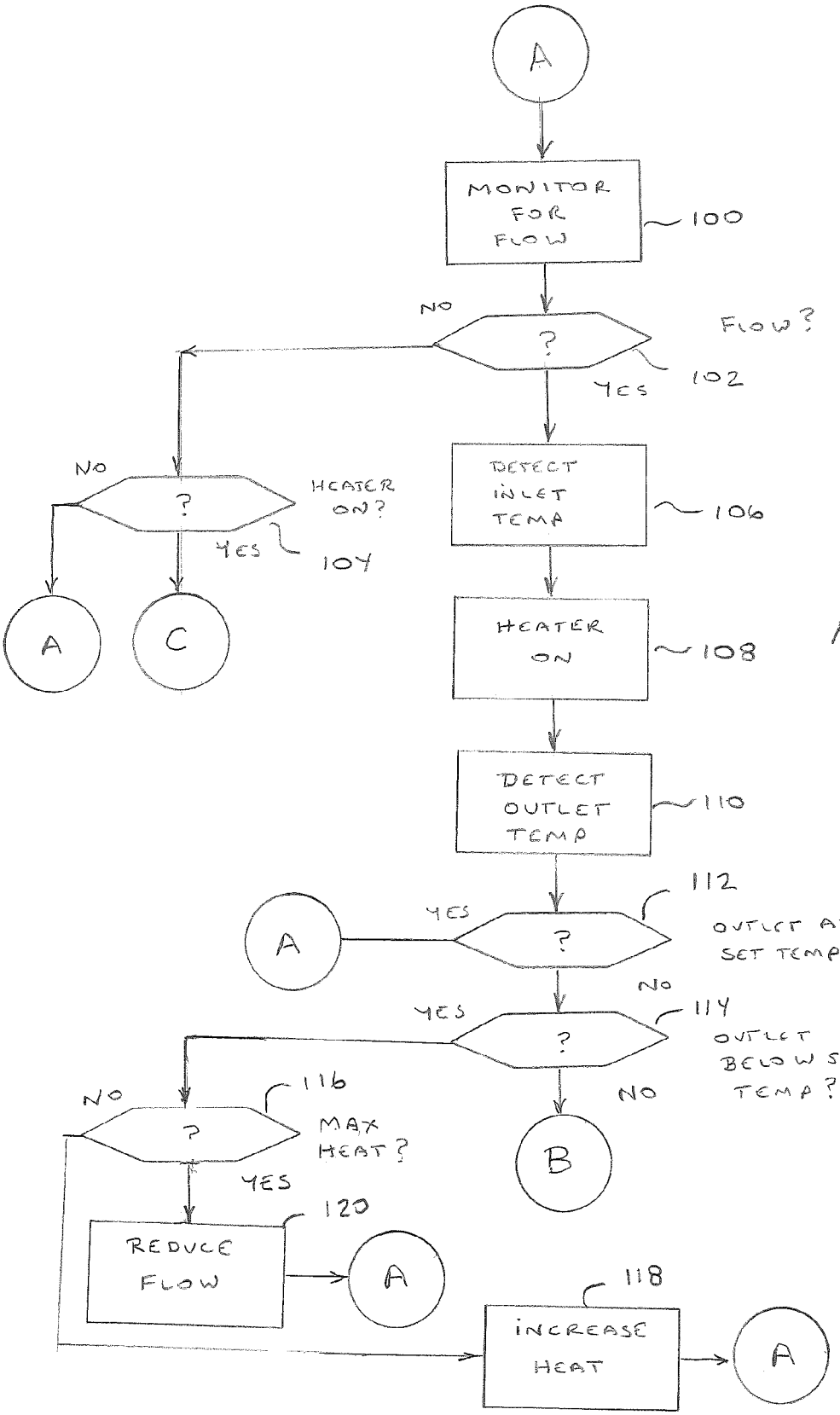
FIGS. 4 and 5 schematically represent logic flow carried out by an exemplary at least one circuit in the operation of an on-demand water heater.

As represented schematically in FIG. 3, in the exemplary arrangement the at least one circuit 40 is in operative connection with a heater control interface 58. The exemplary heater control interface 58 is operative to control a relay circuit or other suitable power delivery circuit 60. The exemplary power delivery circuit is operative responsive to the heater control interface 58 to selectively deliver power from the rechargeable battery pack 46 to the heating elements 26, 28, 30, 32 at a selectively variable battery power pack delivery rate. The heater control interface 58 is operative to cause the amount of power delivered from the battery pack to be varied responsive to the amount of energy needed to heat the water that is currently passing through the heat exchanger 25.

In the exemplary arrangement the rechargeable battery pack is in operative connection with a house current electrical connector 62. In the exemplary arrangement the house current electrical connector 62 includes an electrical connection with the source of house current electrical power. In exemplary arrangements the immediate source of house current electrical power may be an electrical panel 64. The electrical panel 64 may include a circuit which is operative to deliver electrical power provided by an electric public utility connection 66 to the residence or commercial establishment in which the water heater is operated. Alternatively or in addition in some exemplary arrangements the source of house current electrical power may include other power sources such as a solar panel system, wind turbine electrical generation system, a local electrical generator or a central battery power storage system, which may be like those later discussed.

In the exemplary arrangement the source of house current electrical power is limited to supplying power to the house current electrical connector 62 at a power level below a set power level. The set power level in some exemplary arrangements is limited to a power level comparable to the power that is supplied to other devices that use electrical power that are present within the residential or commercial establishment in which the water heater is used. This may include for example, a circuit that delivers 110 V of AC power at a maximum of 30 amps. Of course this value is exemplary and in other arrangements other set power level delivery values may be available from the source of house current electrical power.

In the exemplary arrangement the house current electrical connector 62 is in operative connection with charge control circuitry 68. The charge control circuitry is operative responsive to the at least one circuit 48 to monitor the charge level of the battery pack 46. The exemplary charge control circuit 68 is further operative to selectively provide energy to charge the battery pack 46 when necessary, responsive to energy delivered through the home current electrical connector. Of course it should be understood that this arrangement is exemplary and other arrangements other approaches may be used.

The exemplary water heater is further in operative connection with a house current electrical power sensor schematically indicated 70. The house current electrical power sensor 70 is in operative connection with a supply source 72. The supply source of the exemplary arrangement is a source of house current electrical power that is operative to indicate the availability of electrical power at the house current electrical connector 62. In some exemplary arrangements the house current electrical power sensor may be operative to detect the availability of house current electrical power at a supply source that comprises the house current electrical connector 62. Alternatively or in addition, the house current electrical power sensor may be operative to detect the availability of house current electrical power at a location within the electrical panel 64, such as at a main breaker. Alternatively in other arrangements the house current electrical power sensor may be operative to detect house current electrical power in other locations in connection with the circuitry. Numerous approaches may be utilized for purposes of utilizing the house current electrical power sensor to determine when electrical power becomes unavailable to the house current electrical connector.

The exemplary arrangement further includes at least one house current electrical delivery connector 74. The exemplary at least one house current electrical delivery connector is operative to deliver house current electrical power responsive to power delivered from the battery pack. In the exemplary arrangement the at least one circuit is operative responsive at least in part to detection by the house current electrical power sensor 72 that power is not available to the house current electrical connector, to cause electrical power to be available to at least one device that uses house current electrical power. Such devices may include for example devices that are considered critical to operation of the particular facility in which the system is located.

For example in some exemplary arrangements such devices that use house current electrical power may be supplied with power responsive to delivery of power from the battery pack through suitable rectifier and other circuitry. Such power may be passed from the at least one house current electric delivery connector 74 through the electrical panel 64 through which the particular electrical power use devices are in permanently wired electrical connection. In alternative arrangements the at least one house current electrical delivery connector 74 may be in operative connection with one or more electric plug receptacles 76. Such electric plug receptacles 76 may be configured to be releasably engageable with electrical plugs so as to deliver house current electrical power therefrom. Numerous different arrangements may be provided for purposes of delivering power from the house current electrical delivery connector 74 to devices that utilize such power responsive to power from the rechargeable battery pack when power from the electric utility or other normal electrical power source becomes unavailable. Further in some exemplary arrangements one or more electric plug receptacles 76 may be mounted in operative connection with the water heater so as to provide suitable house current electrical power therefrom responsive to delivery of power from the rechargeable battery pack even in circumstances where electrical power from the supply source remains available. Of course these approaches are exemplary and other arrangements other approaches may be used.

In the exemplary system shown the at least one circuit is operative to supply certain components of a water management system with house current electrical power in circumstances when power from the supply source becomes unavailable. In the exemplary arrangement electrical power is supplied to a master controller 78 of the type described in the incorporated disclosure. The master controller 78 operates in a manner like that described in the incorporated disclosure to wirelessly control operation of the at least one water conditioner 18 and the well pump 16. The exemplary master controller 78 is further operable to wirelessly communicate with user portable wireless devices such as device 56. In the exemplary arrangement house current electrical power is also supplied to slave controllers 80, 82 that are in operative connection with the valves associated with the water conditioners 18. Such slave controllers may operate in the manner described in the incorporated disclosure.

A further slave controller 84 is in operative connection with the well pump. The slave controller 84 is also in operative connection with the house current electrical delivery connector 74 so that the slave controller 84 remains operative along with the well pump 16 when house current electrical power is not available at the supply source. The operation of the water source, in this case the well pump 16, as well as the at least one water conditioner 18 and the associated slave controllers 80, 82 are operative to assure that the water use devices in the facility are supplied with water even in circumstances where the supply electrical power from the public utility or other normal source has been lost.

In the exemplary arrangement the facility includes at least one sump pump 86. The at least one sump pump 86 is operative to pump wastewater that collects in a sump 88 or other retaining basin, to a drain and away from the facility. In the exemplary arrangement the sump pump is operative to collect water that if not removed may cause flooding of a portion of the facility. The exemplary sump pump 86 is supplied with house current electrical power responsive to delivery of power from the battery pack 46 through the delivery connector 74 when power from the supply source is detected as unavailable by the house current electrical power sensor 70. Also supplied with electrical power responsive to the delivery of power from the battery pack is a slave controller 90 that is in operative connection with the sump pump 86. In the exemplary arrangement the slave controller 90 operates in a manner like that discussed in the incorporated disclosure to monitor and control operation of the sump pump. Of course it should be understood that these are examples of devices that in the exemplary arrangement are caused to receive house current electrical power responsive to power delivered from the battery pack in circumstances where electrical power at the supply source becomes unavailable. It should be understood that in other exemplary arrangements different or additional devices may also be supplied with electrical power in such circumstances to assure that critical devices at the facility remain operational as long as power is available from the rechargeable battery pack of the water heater.

In exemplary arrangements the water heater may be utilized in environments that include systems that provide available solar power and/or wind power. In the exemplary arrangement the at least one circuit 48 is in operative connection with a solar panel electrical delivery connector 92. The exemplary solar panel electrical delivery connector 92 is in operative connection with at least one solar panel 94 and suitable circuitry that is operative to deliver electrical power generated through operation of the at least one solar panel 94 to the delivery connector 92. The exemplary water heater may also be utilized in a system that includes a wind turbine electrical delivery connector 96. Wind turbine electrical delivery connector 96 may be in operative connection with at least one wind turbine electric generator 98 and suitable circuitry that is operative to deliver electrical energy from the at least one wind turbine electric generator to the wind turbine electrical delivery connector 96. Of course it should be understood that in other exemplary systems the at least one circuit may be in operative connection with other devices and systems.

Figure 5:
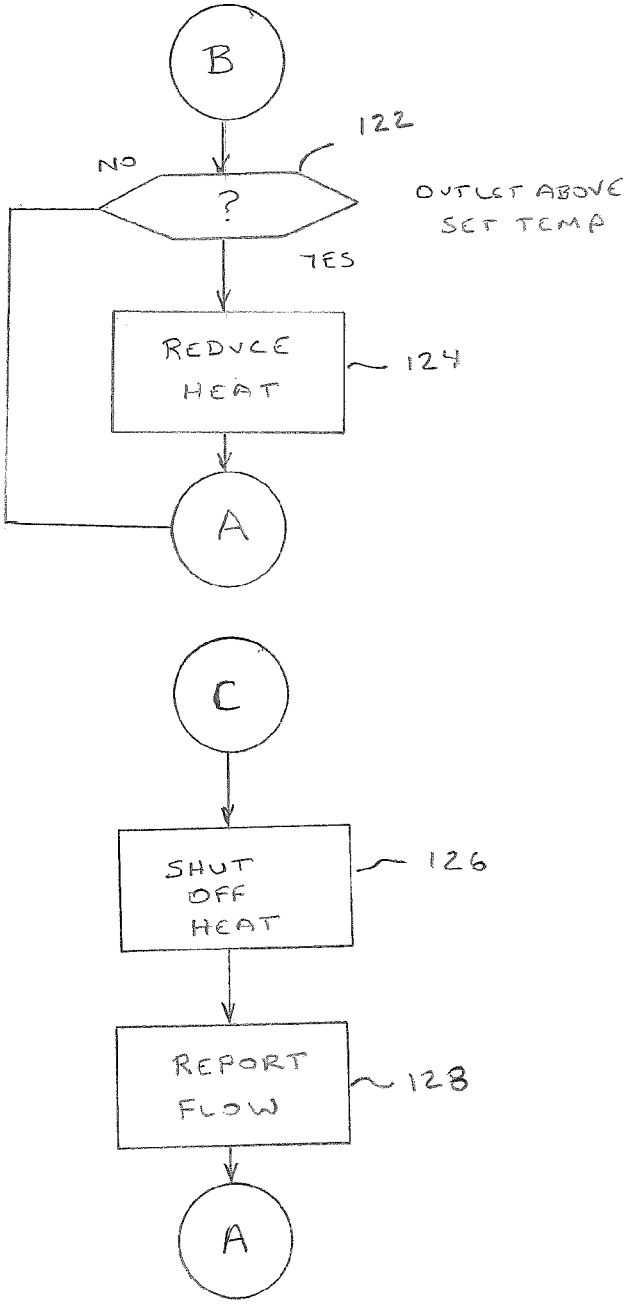
Figure 6:
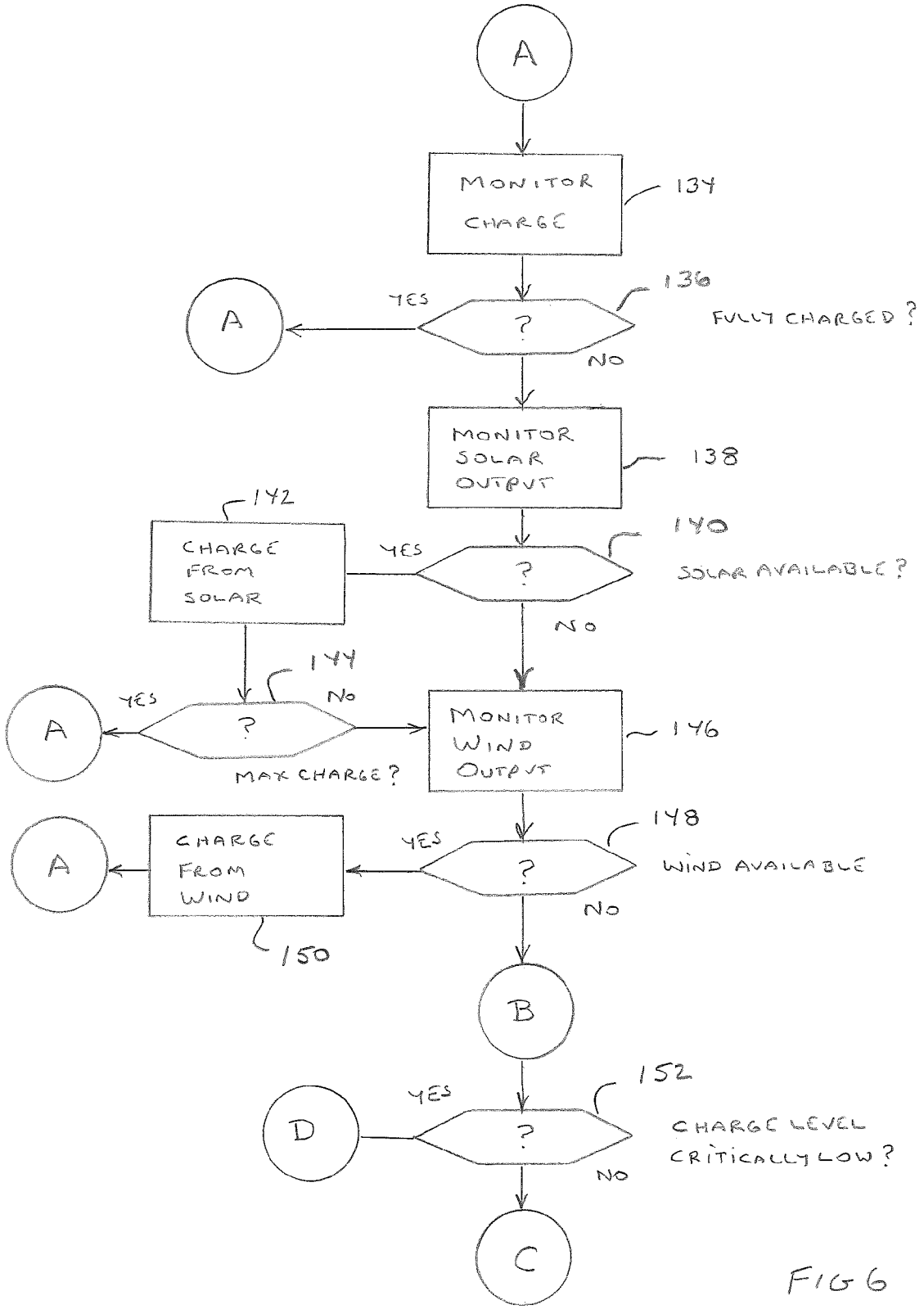
FIGS. 6 and 7 schematically represent logic flow carried out by an exemplary at least one circuit in connection with charging of an exemplary rechargeable battery pack of the on-demand water heater.

FIGS. 5 and 6 represent schematically an exemplary logic flow carried out responsive to operation of the at least one circuit 48. In exemplary arrangement the logic flow is carried out responsive to circuit executable instructions and data corresponding to a set hot water delivery temperature stored in the at least one data store. In exemplary arrangements the set hot water delivery temperature value is changeable by a user through the remote wireless device 56 or other suitable user interface. Of course it should be understood that this logic flow is shown schematically and in other exemplary arrangements the at least one circuit may carry out additional or different steps in connection with operation of the on demand water heater.

In an operational state, the exemplary at least one circuit is operative to monitor for water flow as represented by a step 100. In exemplary arrangements the at least one circuit is operative to monitor for a water flow rate as sensed by the flowmeter 40 which is above a minimum threshold level which corresponds to the opening of the hot water delivery valve or operation of a water use device that requires the use of hot water. As represented by a step 102 the at least one circuit is operative to detect if such flow is occurring. As represented by step 104, if flow is not detected above the minimum threshold in step 102 and the at least one electric heating element is not being currently supplied with electrical power, the logic flow returns to step 100 to continue to monitor for flow to begin. If however it is determined in step 104 that the at least one heating element is currently being supplied with electrical power, the at least one circuit is then operative to discontinue the supply electrical power to the heating element in a manner like that later discussed.

If in step 102 a flow rate above the threshold is detected indicating a demand for hot water, the at least one circuit is then operative to detect the inlet water temperature at the inlet to the heat exchanger at a step 106. This is done through the at least one circuit detecting the temperature reading as determined by the inlet water temperature sensor 38. As represented by step 108 the at least one circuit is operative to cause electrical power to be delivered from the rechargeable battery pack to the at least one heating element. The electrical power delivered from the rechargeable battery pack is delivered at a battery pack power delivery rate that is controlled responsive to stored circuit executable instructions to be sufficient to heat the water passing through the heat exchanger to a water outlet temperature that is about the set hot water delivery temperature stored in the at least one data store. For purposes of this disclosure, a temperature that is about the set hot water delivery temperature includes the set hot water delivery temperature plus or minus a range, which in the exemplary arrangement is a range of plus or minus 5° F. Of course it should be understood that this approach is exemplary and in other arrangements other approaches may be used.

As represented by step 110 the at least one circuit is operative to detect the water outlet temperature. This is done by the at least one circuit receiving signals from the water outlet temperature sensor 44 which detects the temperature corresponding to the temperature of water exiting the heat exchanger outlet. At a step 112 the at least one circuit is operative to determine if the temperature of the water exiting the heat exchanger outlet is at about the set hot water delivery temperature stored in the at least one data store. If in step 112 it is determined that the water temperature at the heat exchanger outlet is at about the set temperature, the logic flow returns to monitor the water flow and continues to heat the water until water flow is no longer occurring.

If in step 112 the at least one circuit determines that the temperature of water exiting the heat exchanger outlet is not at about the set temperature, it is determined as represented in a step 114, whether the water temperature exiting the heat exchanger is below the acceptable range for the set temperature. If in step 114 is determined that the temperature is below the set temperature, the at least one circuit is operative as represented by step 116 to determine if the rechargeable battery pack is currently supplying power at a delivery rate that produces the maximum heat output from all the electrical heating elements. If in step 116 the at least one circuit determines that electrical power from the battery pack is not being delivered at a rate that corresponds to maximum heating, the at least one circuit operates as represented by step 118 to increase the power delivered to the electrical heating elements to increase the heating of the water passing through the heat exchanger. As can be appreciated, in exemplary arrangements the at least one circuit may operate in accordance with its stored circuit executable instructions to increase the heating action based in the difference between the sensed outlet temperature and the set temperature. In some arrangements the at least one circuit may incrementally increase the power delivery rate to the electrical heating elements to provide suitable heating for the water passing through the heat exchanger. Additional power may be required for the heating elements based on a low water inlet temperature, or a buildup of scale or other material in the heat exchanger that limits the effective heat transfer or other conditions. From step 118 the exemplary at least one circuit operates to return to monitor the water flow in step 100.

Alternatively if in step 116 it is determined that the rechargeable battery pack is delivering power at a battery power pack delivery rate that corresponds to the maximum heat output from the electrical heating elements, the exemplary at least one circuit is operative as represented in step 120 to reduce the flow rate through the heat exchanger so as to increase the water outlet temperature to be at about the set hot water delivery temperature. In the exemplary arrangement this is accomplished by the at least one circuit reducing the water flow rate through the heat exchanger through adjustment of the flow control valve 42. As can be appreciated by reducing the rate of the water flow through the heat exchanger, the water that passes through the heat exchanger is in contact with the heat exchanger for a longer period of time. This results in the water being heated to a higher temperature. Of course it should be understood that this approach is exemplary and in other arrangements other approaches may be used.

In the exemplary logic flow if it is determined in step 114 that the temperature of the water at the outlet of the heat exchanger is not below the set temperature range, the at least one circuit operates as represented by step 122 to determine if the outlet temperature is above the set temperature range. If so the at least one circuit operates as represented by step 124 to reduce the battery pack power delivery rate of electrical power being delivered to the electrical heating elements. The reduction in electrical power reduces the heating action of the heating elements to bring the temperature of the water at the outlet down to about the set hot water delivery temperature. The circuit executable instructions stored in the at least one data store may operate to cause the electrical power to the heating elements to be reduced in accordance with the amount that the outlet temperature is above the set hot water delivery temperature. Alternatively or in addition the circuit executable instructions may cause the reduction in heating action in increments until water is delivered from the heat exchanger at a temperature that corresponds to about the set hot water delivery temperature. Of course it should be understood that these approaches are exemplary and in other arrangements other approaches may be used.

In the exemplary arrangement if in step 104 it is determined that the heating elements are operating but the flow of hot water through the heat exchanger has been substantially discontinued, the at least one circuit operates as represented by a step 126 to stop the delivery of electrical power to the heating elements. This causes the heating action to be stopped so that the water in the heat exchanger is no longer being heated. The exemplary arrangements cause the rapid shut off of the heating elements to avoid excessive heating of the water that is held in the heat exchanger to avoid excess pressure, heat or other undesirable conditions. Further in some exemplary arrangements the water heater may include provisions for cooling the heat exchanger when necessary, such as providing a valve that can direct hot water in the heat exchanger to a drain so as to introduce cooler water into the heat exchanger. Alternatively or in addition, air cooling or other types of cooling of the heat exchanger may be provided. Of course these approaches are exemplary and in some arrangements such approaches may not be used and in other arrangements these or other cooling arrangements may be provided.

In the exemplary arrangement the at least one circuit 48 is operative to generate data corresponding to a report of the heating activity which has been carried out as represented by step 128. In exemplary arrangements the at least one circuit includes a clock function 130. The exemplary clock function 130 is usable to provide an indication of the duration of operation of the hot water heater. Further in exemplary arrangements the at least one circuit may be operative responsive to the flowmeter 40 and at least one temperature sensor to determine and report the volume and temperature of the flow of water through the water heater. The exemplary at least one circuit may be operative to cause the information to be resolved by or reported to the controller 54. In exemplary arrangements the controller 54 operates as a slave controller in a manner like that discussed in the incorporated disclosure to wirelessly communicate such information with the master controller 78. In exemplary arrangements the master controller may be operative to utilize this information in controlling other devices such as the at least one water conditioner 18. Such control of the water conditioner may include operation of the water conditioner to regenerate the media or otherwise improve the water conditioning function thereof responsive at least in part to the amount of water heated through operation of the water heater. In exemplary arrangements the conditioning of the water supplied to the water heater may be operative to prevent the formation of scale and/or other contaminants that may impede operation of the water heater. The control of the water quality through operation of the master controller may help to assure extended life and effective operation of the water heater. Of course it should be understood that these approaches are exemplary and in other arrangements other approaches may be used.

In the exemplary arrangement the rechargeable battery pack is operative to deliver power at a battery power pack delivery rate that is much higher than the set power level for electrical power that is available from the house current electrical connector. For purposes hereof the electrical power levels available respectively from the rechargeable battery pack and the house current electrical connector are referred to in terms of the amount of electrical power that could be effectively delivered to the electrical heating elements from each respective source. In exemplary arrangements the power delivered from the rechargeable battery pack to the electrical heating elements provides a battery power pack delivery rate that is at least twice the set power level that is the maximum available power from the house current electrical connector. Further in exemplary arrangements the battery power pack delivery rate is ten times the set power level. This is because the rechargeable battery pack is operative to deliver power at rates of 7000 W to 9000 W in exemplary arrangements to provide water heating capability. In such arrangements the battery pack delivery power may be provided from one or more suitable battery packs such as a Tesla® Powerwall® or a Generac® PWR-Cell® or other suitable rechargeable battery pack. In exemplary arrangements the power available from such a rechargeable battery pack is far in excess of the power that could be delivered on a common household or commercial circuit that provides house current electrical power. Of course it should be understood that these approaches are exemplary and in other arrangements other approaches may be used.

However, in some optional arrangements the effective electrical power available from the house current electrical connector may be sufficiently high to provide a useful contribution to the electrical power delivered to the heating elements. In such circumstances the at least one circuit may be in operative connection with a power delivery interface 132. The power delivery interface 132 may be operated to cause electrical power available at the house current electrical connector to be delivered to the one or more power delivery circuits 60 that are operative to supply electrical power to the electrical heating elements. Thus in this exemplary arrangement house current electrical power that may be available from a public utility, or alternatively from a different source such as a solar panel power connection, a wind turbine power connection, an electric generator, another rechargeable battery pack or other suitable source may be delivered concurrently with power from the rechargeable battery pack 46 for purposes of heating the water that passes through the water heater 12. Of course it should be understood that these approaches are exemplary and in other arrangements other approaches may be used.

Figure 7:
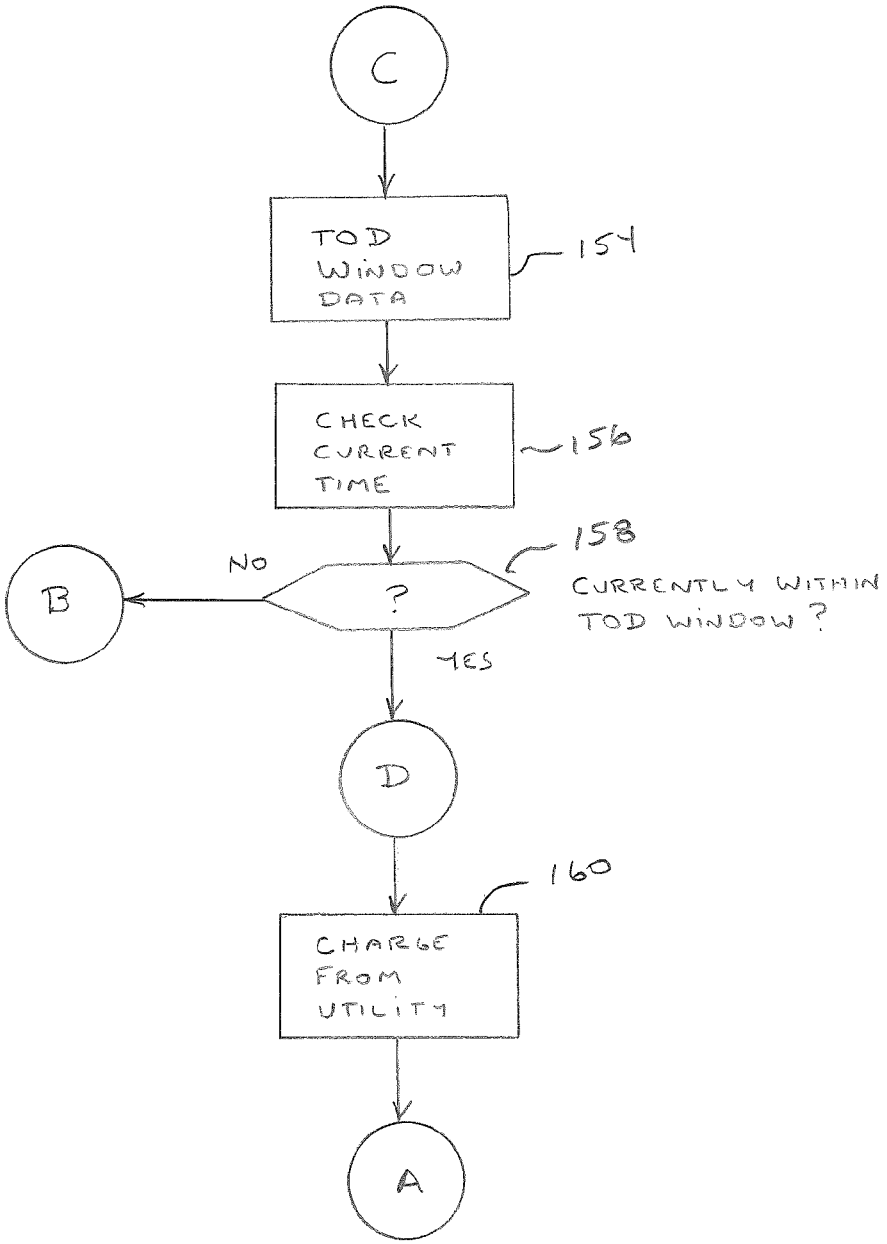

FIGS. 6 and 7 represent an exemplary logic flow carried out responsive to operation of the at least one circuit to maintain the rechargeable battery pack suitably charged in connection with the operation of exemplary system 10. In this exemplary arrangement the at least one circuit is operative to monitor a level of charge of the rechargeable battery pack as represented by a step 134. This is done in exemplary arrangements through the circuitry including the charge control circuitry 68. In a step 136 it is determined if the battery pack is fully charged. If so the at least one circuit continues to monitor the charge level of the battery pack.

If in step 136 it is determined that the battery pack is not fully charged the at least one circuit is operative to monitor whether solar power is available at the solar panel electrical delivery connector 92 at a level usable for charging the battery pack. This is represented by a step 138. If in a step 140 is determined that solar power is available, the at least one circuit is operative to cause the rechargeable battery pack to be recharged using power delivered from the at least one solar panel as represented by step 142. At a step 144 the at least one circuit is operative to make a determination if the power available from the at least one solar panel is sufficient to provide the maximum charging power required at the current time by the rechargeable battery pack. If so the logic flow returns to step 134 in which the at least one circuit monitors the charge level of the battery pack.

Alternatively if in step 140 solar power is determined not to be available at a usable level for charging the battery pack, or if in step 144 the power level available from the solar panels is not a set maximum amount of power that can be used for purposes of charging the battery pack, the at least one circuit is operative as represented by a step 146 to determine whether the usable amount of power that is available from the wind turbine electric generator. In a step 148 a determination is made concerning whether the power level available from the wind turbine electric generator is a usable amount for purposes of charging the rechargeable battery pack. If so the at least one circuit operates as represented by step 150 to apply the power generated by the wind turbine electric generator to charging the rechargeable battery pack.

In the exemplary arrangement if power for charging the battery pack is not available from either the solar panels or the wind turbine electric generator, a determination is made as represented by step 152 concerning whether the charge level of the battery pack is below a set threshold that is stored in the at least one data store. This set threshold corresponds to a level at which charging of the battery pack is required even though the operator of the system may incur a higher cost of electricity for purposes of charging the battery pack.

In exemplary arrangements the at least one data store 52 includes data corresponding to one or more time of day (TOD) windows. In exemplary arrangements these TOD windows correspond to time windows during which electrical power from the utility company is supplied at lower rates that are considered by the operator or the system to be acceptable for purposes of charging the rechargeable battery pack. In some exemplary arrangements the system may be operated in a region where the electrical utility supplier charges higher rates for electricity during certain days and/or certain times of day compared to other days or times of day. In such exemplary arrangements the at least one data store may be programmed to include the time of day windows that correspond to when electrical power is available from the utility at the lower rates.

In the exemplary arrangement if in step 152 it is determined that the charge level of the battery pack is not critically low, the at least one circuit is operative to resolve the TOD window data from the at least one data store. This is represented by step 154. The at least one circuit is then operative to determine the current time as represented by step 156. This is done responsive to the clock function 130 associated with the at least one circuit 48. As represented by a step 158 the at least one circuit is operative to determine if the current time is within a TOD window in which electrical power is available from the utility at a rate that is indicated as acceptable to the system operator. If in step 158 it is determined that the current time is within a TOD window, the at least one circuit is operative as represented by step 160 to cause the rechargeable battery pack to be charged using electricity delivered through the house current electrical connector from the public utility.

Alternatively, if in step 152 it is determined that the charge level a battery pack is critically low, the at least one circuit is operative to cause the battery pack to be recharged through the house current electrical connector using electrical power delivered from the public utility. This is done regardless of whether the current time corresponds to a TOD window during which electricity can be obtained from utility at the desired lower rates. Of course it should be understood that this approach is exemplary and in other arrangements other approaches may be used.

Figure 8:
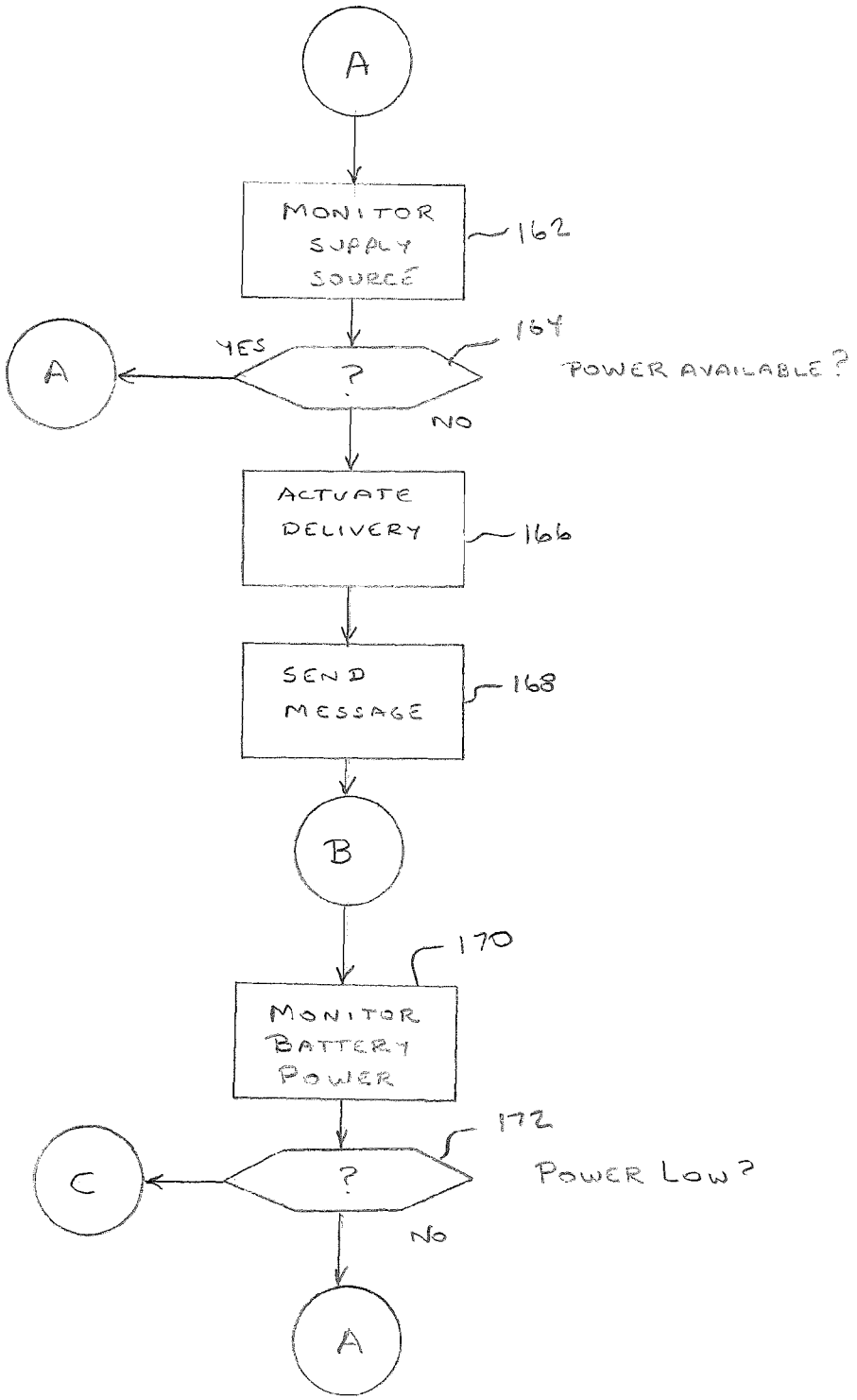
FIGS. 8 and 9 schematically represent logic flow carried out by an exemplary at least one circuit in connection with using the rechargeable battery pack of the water heater as an emergency source of electric power.
Figure 9:
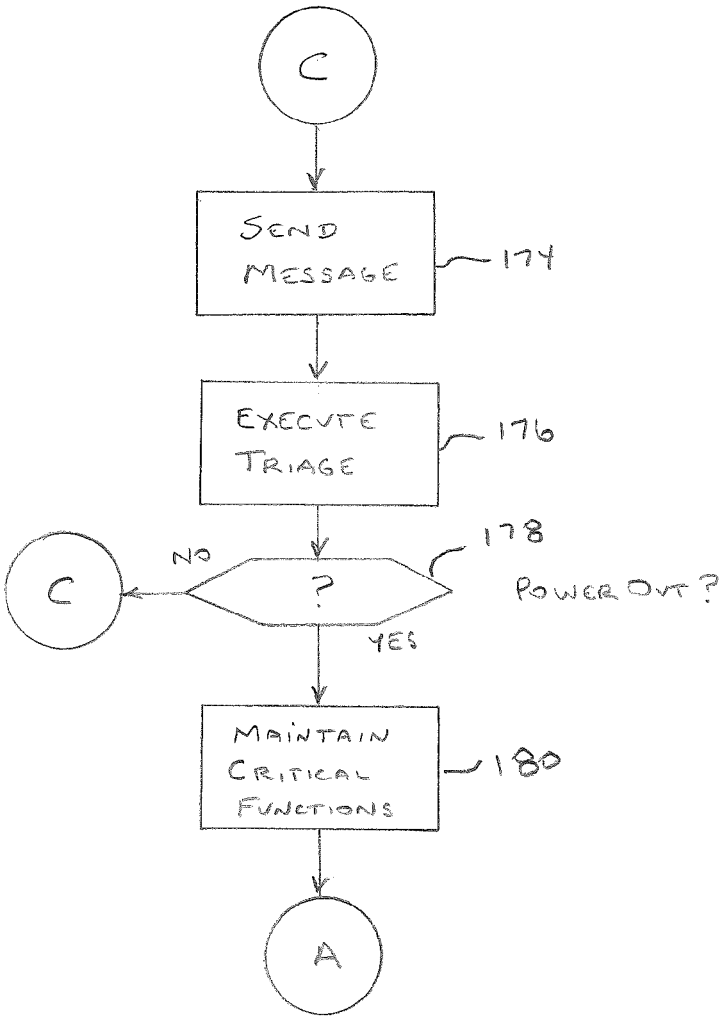

FIGS. 8 and 9 schematically represent a logic flow carried out by the at least one circuit 48 to deliver power to the house current electrical delivery connector and other critical power use devices in the facility when house current electrical power from other sources is not available. This enables the rechargeable battery pack associated with the water heater to provide electrical power for the selected critical devices so that the operation thereof may be maintained. As represented in FIG. 8 the at least one circuit operates as represented by step 162 to monitor for available power at the supply source 72. As can be appreciated the supply source 72 may include in some arrangements the house current electrical power sensor 70 detecting the availability of power at the house current electrical connector 62. Alternatively in other arrangements house current electrical power sensor 70 may be operative to detect availability of power at a supply source that comes from a public utility, at a location in the electrical panel 64. Alternatively or in addition the house current electrical power sensor may be operative to monitor for the availability of electrical power from one more of a solar panel array, wind turbine electric generator, electric generator, other rechargeable battery pack or other source of house current electrical power.

As represented by step 164 the at least one circuit is operative to determine through operation of the house current electrical power sensor 70, if power is available at the supply source 72. If so the at least one circuit continues to monitor the availability of power at the supply source. If however power becomes unavailable, the at least one circuit is operative as represented by step 166 to cause power to be delivered to the house current electrical delivery connector 74 responsive to power delivered from the battery pack. Further in exemplary arrangements the at least one circuit is operative to cause at least one wireless message to be sent to a user portable wireless device 56 associated with an operator of the system to advise that power is unavailable from the supply source. This is represented by step 168. This may be accomplished in some exemplary arrangements by the controller 54 operating in the water heater causing a wireless message to be sent to the user wireless device directly. Alternatively in other arrangements the controller 54 may be operative to communicate one or more wireless messages indicative of the condition to the master controller 78. The master controller may operate in a manner like that described in the incorporated disclosure to send one or more wireless messages to the user portable wireless device. Of course it should be understood that these approaches are exemplary and in other arrangements other approaches may be used.

In the exemplary logic flow the at least one circuit is operative in accordance with its stored circuit executable instructions to monitor the available battery power as represented by step 170. The at least one circuit is operative as represented by step 172 to determine if the available battery power has been reduced to a low set threshold that corresponds to stored data. In exemplary arrangements the low set threshold may include a level of available power that may be such that the unit is unable to carry out a water heating function at a set flow rate. Of course in other arrangements the low power set threshold may be set at other levels. Responsive at least in part to the available battery power falling to the threshold as determined in step 172, the controller 54 or other circuitry is operative to send a message indicative of the condition to the user portable wireless device 56. This is represented by step 174. In some exemplary arrangements the exemplary system may operate in the manner of the incorporated disclosure to enable the controller 54 and/or the master controller 78 to receive wireless instruction messages from the user's portable wireless device 56. In some exemplary arrangements the instruction messages may include instructions to discontinue operation of certain devices and/or functions. For example in some exemplary arrangements the at least one wireless instruction messages from the portable wireless device may include instructions to discontinue operation of the well pump. Responsive at least in part to the receipt of the wireless instruction messages from the portable wireless device 56, the controller 54 and/or controller 78 may operate send wireless messages to slave controllers associated with the devices that are to discontinue operation. This may include for example sending an instruction message to the slave controller 84 to discontinue operation of the well pump 16. Further in other exemplary arrangements the wireless instruction messages from the portable wireless device 56 may be operative to cause the applicable controller to cause the at least one circuit to discontinue operation of the water heater. Numerous other or additional actions may be taken responsive to messages received from the user portable wireless device.

In some exemplary arrangements the at least one data store 52 may include circuit executable instructions that correspond to a sequence of devices or actions that are to be discontinued automatically when the power level threshold is reached in step 172. These instructions may correspond to a triage sequence which includes instructions that cause the at least one circuit to discontinue operation of certain functions or devices in a particular order and/or with particular timing. The at least one circuit is operative to carry out these instructions as represented by step 176.

In the exemplary arrangement the at least one circuit is operative to monitor the level of available power as represented by step 178 to determine if the available power reaches a lower set threshold that corresponds to data stored in the at least one data store, beyond that used in step 172. This lower set threshold utilized in connection with step 178, corresponds to a condition in which the available power from the rechargeable battery pack is depleted for purposes of carrying out additional functions. When the at least one circuit determines that this power out threshold has been reached in step 178, the exemplary circuit is operative to discontinue operations other than the maintenance of critical functions. This is represented by a step 180. The critical functions may include for example, maintaining the information in the data store and the monitoring functions which enable the at least one circuit to resume operations once the availability of power is restored. Of course it should be understood that these approaches are exemplary and in other arrangements and systems, other approaches and functions may be utilized in connection with the system that includes the exemplary water heater.

Figure 10:
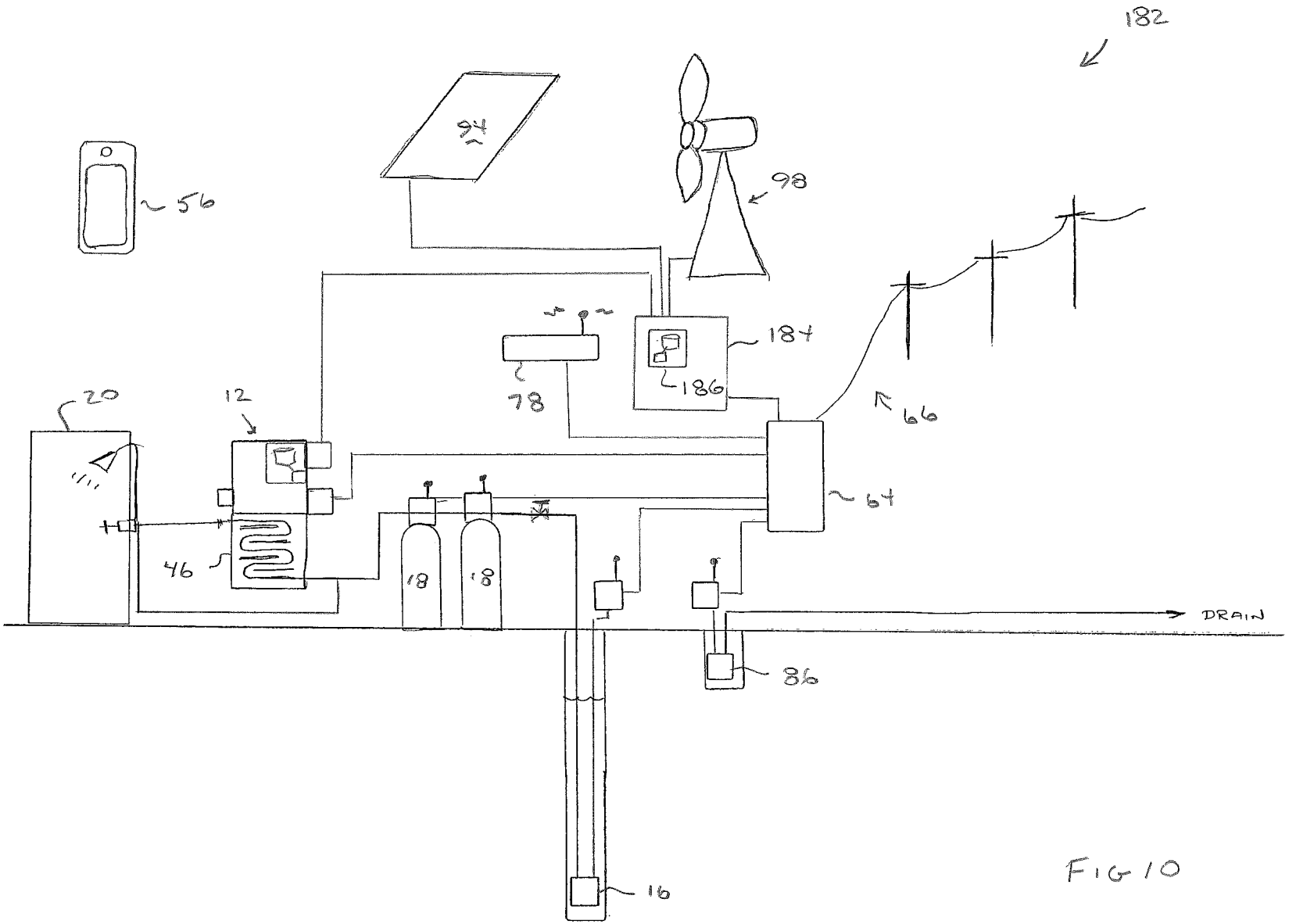
FIG. 10 is a schematic view of an alternative system including an on-demand water heater.

A further alternative arrangement in which the exemplary water heater 12 may be utilized is indicated 182 in FIG. 10. This alternative system 182 is similar to system 10 previously discussed and includes many of the same components. Those components that are common to system 10 are labeled with the same reference numerals in FIG. 10. System 182 differs from system 10 in that includes a battery storage system 184 that provides power management to the residential or commercial facility or a selected portion thereof. In this exemplary arrangement the battery storage system is in operative connection with power control circuitry 186. The exemplary power control circuitry 186 includes at least one processor and at least one data store of the types previously discussed. In the exemplary arrangement the power control circuitry 186 includes circuit executable instructions that are operative to control the receipt and delivery of power to the battery storage system from the electric public utility connection 66, the solar panel system 94 and the wind turbine electric generator 98. In exemplary arrangements the water heater 12 and the rechargeable battery pack thereof are also in operative connection with the battery storage system 184. In exemplary arrangements the battery storage system 184 may be operable to deliver house current electrical power through the electrical panel 64 in the event that power from the public utility connection or other usual source is not available.

Further in the exemplary arrangement the rechargeable battery pack of the water heater provides a source of power that can be utilized by the battery storage system in situations where power is needed for operating other devices. This is carried out in exemplary arrangements by the at least one circuit 48 communicating with the power control circuitry 186 to make available power from the rechargeable battery pack 46 of the water heater when directed.

Figure 11:
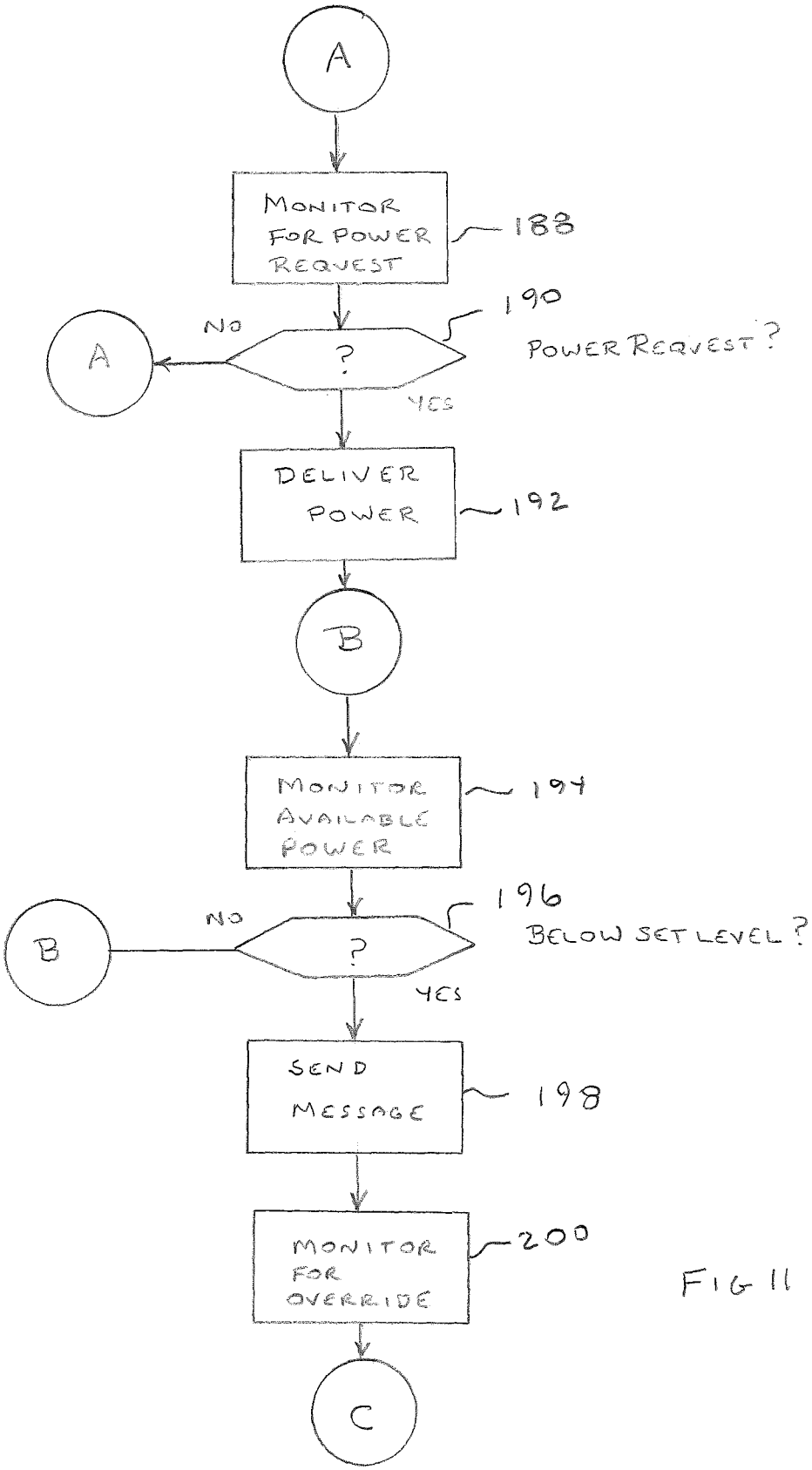
FIGS. 11 and 12 are a schematic representation of logic flow carried out by at least one circuit in connection with using the rechargeable battery pack of the water heater in conjunction with a household electrical supply system.
Figure 12:
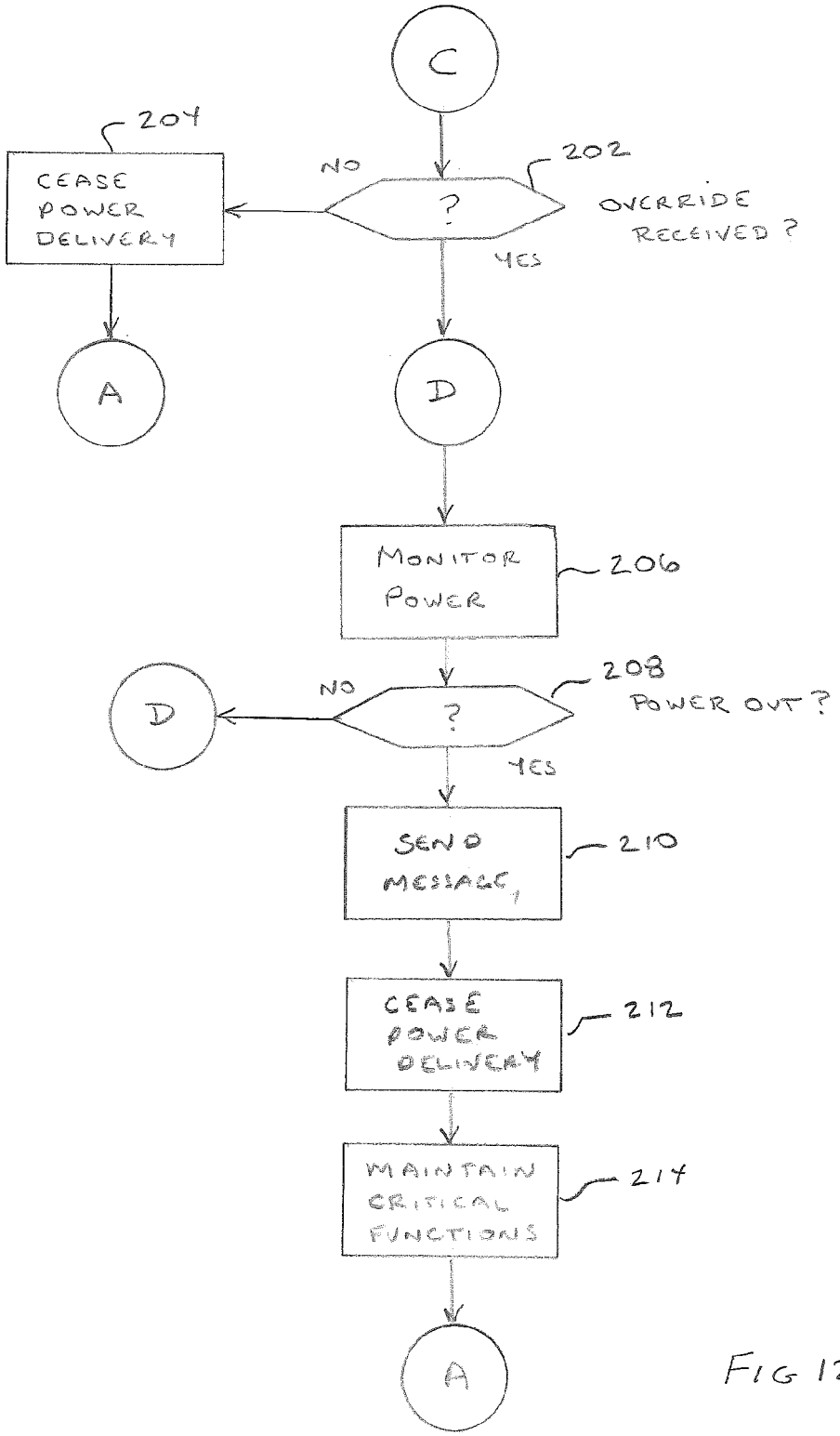

In this alternative system arrangement, the at least one circuit 48 is operative responsive to circuit executable instructions stored in the at least one data store to operate in a manner like that schematically represented in FIGS. 11 and 12. In this exemplary logic flow the water heater is operative to make power available to supplement power available from the battery storage system 184 and other power sources when necessary as determined by the power control circuitry 186.

In this exemplary arrangement the at least one circuit 48 is operative to monitor for communications with the power control circuitry 186 for a power request. This is represented by step 188. When a power request is received as represented by step 190, the at least one circuit 48 is operative to cause power to be delivered from the rechargeable battery pack 46 to a distribution connection within the system as directed by the power control circuitry 186. In exemplary arrangements this may include power switching control circuitry which is in operative connection with the power control circuitry or other suitable power directing device. This may include for example, directing power to devices through the electrical panel 64 in a manner like that previously discussed. The delivery of power as represented schematically by step 192.

The at least one circuit 48 is operative as represented by step 194 to monitor the power available from the rechargeable battery pack 46. When the available power falls to a set level as determined by a step 196, the at least one circuit is operative to communicate at least one message to the power control circuitry 186. This is represented by step 198. In the exemplary arrangement the at least one circuit 48 is then operative as represented by step 200 to monitor for receipt of an override message from the power control circuitry 186. In the exemplary arrangement an override message will be provided by the power control circuitry in circumstances when the power control circuitry requires the override of the programming included in the at least one data store 52. In exemplary arrangements the at least one circuit 48 may operate in accordance with its circuit executable instructions to wait for a set period of time for receipt of an override message before executing additional steps. In alternative arrangements other criteria may be utilized for purposes of determining the parameters for monitoring for override instructions.

As represented by step 202 the at least one circuit is then operative to determine if an override message has been received in accordance with the programmed parameters in the at least one data store 52. If no override message is received, the at least one circuit 48 is then operative to cause the delivery of power from the rechargeable battery pack 46 to be discontinued. This is represented by step 204. If however in step 202 an override message is received from the battery control circuitry 186, the at least one circuit continues to deliver power and continues to monitor the power level available from the battery pack as represented by step 206. If is determined as represented by step 208 that the available power has fallen to a set level which corresponds to delivery of all available power from the rechargeable battery pack, the circuitry operates as represented by step 210 to send at least one message to the power control circuitry to indicate that the available power has been exhausted and to thereafter discontinue the delivery of power from the rechargeable battery pack as represented by step 212.

In exemplary arrangements the at least one circuit 48 then operates in accordance with the associated circuit executable instructions to maintain critical functions with electrical power from the rechargeable battery pack. This is represented by step 214. Such functions may include maintaining the data stored in memory in the at least one data store 52, as well as the capabilities for the system to recover once a supply of house current electrical power has been restored. Of course it should be understood that these arrangements are exemplary and in other arrangements other approaches may be used.

As can be appreciated from the foregoing description, the exemplary hot water heater provides numerous useful features for purposes of delivering hot water on an immediate as needed basis. Exemplary arrangements also provide power conservation by utilizing power only as necessary to heat the water actually used and to maintain the rechargeable battery pack. Further in exemplary arrangements the water heater may be installed in facilities without the need to make changes to existing electrical service and/or power delivery components. Further the exemplary system can serve as a source of electrical power when other sources of electrical power are unavailable. Numerous additional advantages will be apparent from the foregoing description.

Thus the exemplary arrangements achieve improved operation, eliminate difficulties encountered in the use of prior devices and systems and attain the useful results described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful features are not limited to the exact features that have been shown and described.

It should be understood that the features and/or relationships associated with one arrangement can be combined with features and/or relationships from other arrangements. That is, various features and/or relationships from various arrangements can be combined to produce further arrangements. The inventive scope of the disclosure is not limited to the arrangements that have been specifically shown and described herein.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. Apparatus comprising:

an on demand water heater including:

at least one electrical heating element, a heat exchanger, wherein the heat exchanger includes a heat exchanger water inlet and a heat exchanger water outlet, wherein the at least one electrical heating element is in thermal connection with the heat exchanger intermediate of the heat exchanger water inlet and the heat exchanger water outlet, wherein the heat exchanger water inlet is configured to be fluidly connected to a water source, and the heat exchanger water outlet is configured to be fluidly connected to at least one water use device, a water inlet temperature sensor, wherein the water inlet temperature sensor is operative to sense an inlet water temperature corresponding to temperature of water entering the heat exchanger water inlet, a water outlet temperature sensor, wherein the water outlet temperature sensor is operative to sense an outlet water temperature corresponding to temperature of water exiting from the heat exchanger water outlet, a flowmeter, wherein the flowmeter is operative to sense a water flow rate corresponding to rate of water flow passing through the heat exchanger from the water inlet to the water outlet, a house current electrical connector, wherein the house current electrical connector is configured to electrically connect to a source of house current electrical power, which source is limited to supplying house current electrical power at below a set power level, a rechargeable battery pack, at least one circuit, wherein the at least one circuit is in operative connection with at least one data store, wherein the at least one data store includes data corresponding to a set hot water delivery temperature, the at least one electrical heating element, the water inlet temperature sensor, the water outlet temperature sensor, the flowmeter, the rechargeable battery pack, the house current electrical connector, wherein the at least one circuit is operative to cause responsive at least in part to the water flow rate sensed by the flowmeter and the inlet water temperature sensed by the water inlet temperature sensor, electrical power to be delivered from the rechargeable battery pack to the at least one electrical heating element at a battery pack power delivery rate to cause the water outlet temperature to be at about the set hot water delivery temperature, wherein the battery pack power delivery rate is at least twice the set power level, the rechargeable battery pack to receive electrical power delivered through the house current electrical connector, wherein the electrical power delivered through the house current electrical connector is operative to charge the rechargeable battery pack.

2. The apparatus according to claim 1 wherein the battery pack power delivery rate is at least 10 times the set power level.

3. The apparatus according to claim 1 wherein the at least one circuit is further operative to cause power to be delivered to the at least one electrical heater element concurrently from both the house current electrical connector and the rechargeable battery pack.

4. The apparatus according to claim 1
wherein the at least one circuit is further operative to cause
electrical power to be delivered from the rechargeable battery pack responsive at least in part to the outlet water temperature sensed by the water outlet temperature sensor.

5. The apparatus according to claim 1
and further including
a house current electrical delivery connector, wherein the house current electrical delivery connector is in operative connection with the rechargeable battery pack and is operable to deliver house current electric power at the house current electrical delivery connector responsive to power delivered from the rechargeable battery pack.

6. The apparatus according to claim 1
and further including
a house current electrical delivery connector, wherein the house current electrical delivery connector is in operative connection with and is operable to delivery power that originates from the rechargeable battery pack,
a house current electrical power sensor, wherein the house current electrical power sensor is in operative connection with a supply source, wherein the supply source is other than the rechargeable battery pack and operative to supply electrical power to the house current electrical connector, wherein the house current electrical power sensor is operative to sense unavailability of house current electrical power at the supply source,
wherein the at least one circuit is in operative connection with the house current electrical delivery connector and the house current electrical power sensor,
wherein the at least one circuit is operative to cause
responsive at least in part to the house current electrical power sensor not sensing unavailability of house current electrical power at the supply source, house current that originates from electrical power delivered from the rechargeable battery pack to not be delivered at the house current electrical delivery connector,
responsive at least in part to sensed unavailability of house current electrical power by the house current electrical power sensor at the supply source, house current electrical power to be delivered at the house current electrical delivery connector that originates from electrical power delivered from the rechargeable battery pack.

7. The apparatus according to claim 6
wherein the house current electrical delivery connector includes at least one electric plug receptacle that is releasably engageable with an electric plug.

8. The apparatus according to claim 1
and further including
a house current electrical delivery connector, wherein the house current electrical delivery connector is in operative connection with and is operable to delivery power that originates from the rechargeable battery pack,
a house current electrical power sensor, wherein the house current electrical power sensor is in operative connection with a supply source, wherein the supply source is other than the rechargeable battery pack and is operative to supply electrical power to the house current electrical connector, wherein the house current electrical power sensor is operative to sense unavailability of house current electrical power at the supply source,
wherein the at least one circuit is in operative connection with the house current electrical delivery connector and the house current electrical power sensor,
wherein the at least one circuit is operative to cause
responsive to the house current electrical power sensor not sensing unavailability of house current electrical power at the supply source, house current that originates from electrical power delivered from the rechargeable battery pack to not be delivered at the house current electrical delivery connector,
responsive to sensed unavailability of house current electrical power by the house current electrical power sensor at the supply source, house current electrical power to be delivered at the house current electrical delivery connector that originates from electrical power delivered from the rechargeable battery pack, wherein the house current electrical delivery connector is in permanently wired connection with an electrical device that uses house current electrical power.

9. The apparatus according to claim 1
and further including
a house current electrical delivery connector, wherein the house current electrical delivery connector is in operative connection with and is operable to deliver power that originates from the rechargeable battery pack,
a house current electrical power sensor, wherein the house current electrical power sensor is in operative connection with a supply source, wherein the supply source is other than the rechargeable battery pack and is operative to supply electrical power to the house current electrical connector, wherein the house current electrical power sensor is operative to sense unavailability of house current electrical power at the supply source,
wherein the at least one circuit is in operative connection with the house current electrical delivery connector and the house current electrical power sensor,
wherein the at least one circuit is operative to cause
responsive to the house current electrical power sensor not sensing unavailability of house current electrical power at the supply source, house current that originates from electrical power delivered from the rechargeable battery pack to not be delivered at the house current electrical delivery connector,
responsive to sensed unavailability of house current electrical power by the house current electrical power sensor at the supply source, house current electrical power to be delivered at the house current electrical delivery connector that originates from electrical power delivered from the rechargeable battery pack, wherein the house current electrical delivery connector is in permanently wired connection with at least one electrical device that uses house current electrical power,
wherein the at least one electrical device includes at least one of
a sump pump, and
a water supply pump.

10. The apparatus according to claim 1
and further including
a house current electrical delivery connector, wherein the house current electrical delivery connector is in operative connection with and is operable to deliver power that originates from the rechargeable battery pack, a house current electrical power sensor, wherein the house current electrical power sensor is in operative connection with a supply source, wherein the supply source is other than the rechargeable battery pack and is operative to supply electrical power to the house current electrical connector wherein the house current electrical power sensor is operative to sense unavailability of house current electrical power at the supply source, wherein the at least one circuit is in operative connection with the house current electrical delivery connector and the house current electrical power sensor, wherein the at least one circuit is operative to cause responsive to the electrical house current power sensor not sensing unavailability of house current electrical power at the supply source, house current that originates from electrical power delivered from the rechargeable battery pack to not be delivered at the house current electrical delivery connector, responsive to sensed unavailability of house current electrical power at the supply source by the house current electrical power sensor, house current electrical power to be delivered at the house current electrical delivery connector that originates from electrical power delivered from the rechargeable battery pack, wherein the house current electrical delivery connector is in wired connection with at least one electrical device that uses house current electrical power, wherein the at least one electrical device includes a master controller that is operative to control a water conditioner, wherein the water conditioner is operative to treat water to at least one of soften, disinfect, remove ions and oxidize contaminants in water and to cause water that has been treated by operation of the water conditioner to be delivered to the heat exchanger inlet, and cause at least one wireless message to be sent to a user portable wireless device indicative of the unavailability of house current electrical power at the supply source.

11. The apparatus according to claim 1 and further including a house current electrical delivery connector, wherein the house current electrical delivery connector is in operative connection with and is operable to deliver power that originates from the rechargeable battery pack, a house current electrical power sensor, wherein the house current electrical power sensor is in operative connection with a supply source, wherein the supply source is other than the rechargeable battery pack and is operative to supply electrical power to the house current electrical connector, wherein the house current electrical power sensor is operative to sense unavailability of house current electrical power at the supply source, wherein the at least one circuit is in operative connection with the house current electrical delivery connector and the house current electrical power sensor, wherein the at least one circuit is operative to cause responsive to the electrical house current power sensor not sensing unavailability of house current electrical power at the supply source, house current that originates from electrical power delivered from the rechargeable battery pack to not be delivered at the house current electrical delivery connector, responsive to sensed unavailability of house current electrical power at the supply source by the house current electrical power sensor, house current electrical power to be delivered at the house current electrical delivery connector that originates from electrical power delivered from the rechargeable battery pack, wherein the house current electrical delivery connector is in wired connection with at least one electrical device that uses house current electrical power, wherein the at least one electrical device includes a master controller that is operative to control a water conditioner, wherein the water conditioner is operative to cause water that has been treated by operation of the water conditioner to be delivered to the heat exchanger inlet, and cause at least one wireless message to be sent to a user portable wireless device indicative of unavailability of house current electrical power at the supply source, and at least one of an electrical pump that selectively causes water from the water source to be delivered to the at least one water use device, and a valve that is selectively operative to control water flow from the water source and that is electrically changeable between an open condition in which water is enabled to be delivered from the water source to the at least one water use device, and a closed condition in which water is prevented from being delivered from the source to the at least one water use device, wherein the at least one of the pump and the valve are in operative connection with the master controller, wherein the master controller is operative responsive at least in part to receipt of at least one wireless instruction message from the user portable wireless device to cause at least one of the pump to be shut off and the valve to be in the closed condition, wherein water from the water source is not delivered to the at least one water use device.

12. The apparatus according to claim 1 and further including a house current electrical delivery connector, wherein the house current electrical delivery connector is in operative connection with and is operable to deliver power that originates from the rechargeable battery pack, a house current electrical power sensor, wherein the house current electrical power sensor is in operative connection with a supply source, wherein the supply source is other than the rechargeable battery pack and is operative to supply electrical power to the house current electrical connector, wherein the house current electrical power sensor is operative to sense unavailability of house current electrical power at the supply source, wherein the at least one circuit is in operative connection with the house current electrical delivery connector and the house current electrical power sensor, wherein the at least one circuit is operative to cause responsive to the electrical house current power sensor not sensing unavailability of house current electrical power at the supply source, house current that originates from electrical power delivered from the rechargeable battery pack to not be delivered at the house current electrical delivery connector, responsive to sensed unavailability of house current electrical power at the supply source by the house current electrical power sensor, house current electrical power to be delivered at the house current electrical delivery connector that originates from electrical power delivered from the rechargeable battery pack, wherein the house current electrical delivery connector is in wired connection with at least one electrical device that uses house current electrical power, wherein the at least one electrical device includes a master controller that is operative to control a water conditioner, wherein the water conditioner is operative to treat water to at least one of soften, disinfect, remove ions, and oxidize contaminants in water and to cause water that has been treated by operation of the water conditioner to be delivered to the heat exchanger inlet, and cause at least one wireless message to be sent to a user portable wireless device indicative of the loss of house current electrical power at the supply source, and an electrical pump that selectively causes water from the water source to be delivered to the at least one water use device, wherein the pump is in operative connection with the master controller, wherein the master controller is operative responsive at least in part to receipt of at least one wireless instruction message from the user portable wireless device to cause the pump to be shut off.

13. The apparatus according to claim 1 and further including a house current electrical delivery connector, wherein the house current electrical delivery connector is in operative connection with and is operable to deliver power that originates from the rechargeable battery pack, a house current electrical power sensor, wherein the house current electrical power sensor is in operative connection with a supply source, wherein the supply source is other than the rechargeable battery pack and is operative to supply electrical power to the house current electrical connector, wherein the house current electrical power sensor is operative to sense unavailability of house current electrical power at the supply source, wherein the at least one circuit is in operative connection with the house current electrical delivery connector and the house current electrical power sensor, wherein the at least one circuit is operative to cause responsive to the electrical house current power sensor not sensing unavailability of house current electrical power at the supply source, house current that originates from electrical power delivered from the rechargeable battery pack to not be delivered at the house current electrical delivery connector, responsive to sensed unavailability of house current electrical power at the supply source by the house current electrical power sensor, house current electrical power to be delivered at the house current electrical delivery connector that originates from electrical power delivered from the rechargeable battery pack, wherein the house current electrical delivery connector is in wired connection with at least one electrical device that uses house current electrical power, wherein the at least one electrical device includes a master controller that is operative to control a water conditioner, wherein the water conditioner is operative to cause water that has been treated by operation of water conditioner to be delivered to the heat exchanger inlet, cause at least one wireless message to be sent to a user portable wireless device indicative of unavailability of house current electrical power at the supply source and, a valve that is selectively operative to control water flow from the water source and that is electrically changeable between an open condition in which water delivered from the water source is enabled to be delivered to the at least one water use device, and a closed condition in which water from the water source is prevented from being delivered to the at least one water use device, wherein the valve is in operative connection with the master controller, wherein the master controller is operative responsive at least in part to receipt of at least one wireless instruction message from the user portable wireless device to cause the valve to be in the closed condition.

14. The apparatus according to claim 1 and further comprising:

a solar panel electrical delivery connector, wherein the solar panel electrical delivery connector is configured to be in operative connection with at least one electricity generating solar panel and to deliver electricity therefrom, wherein the at least one circuit is in operative connection with the solar panel electrical delivery connector, wherein the at least one circuit is operative to cause the rechargeable battery pack to receive electrical power delivered through the solar panel electrical delivery connector, wherein electrical power delivered through the solar panel electrical delivery connector is operative to charge the rechargeable battery pack.

15. The apparatus according to claim 1 and further comprising:

a wind turbine electrical delivery connector, wherein the wind turbine electrical delivery connector is configured to be in operative connection with at least one electricity generating wind turbine, wherein the at least one circuit is in operative connection with the wind turbine electrical delivery connector, wherein the at least one circuit is operative to cause the rechargeable battery pack to receive electricity delivered through the wind turbine electrical delivery connector, wherein electrical power delivered through the wind turbine electrical delivery connector is operative to charge the rechargeable battery pack.

16. The apparatus according to claim 1 wherein the at least one electrical heating element only receives electrical power that originates from the rechargeable battery pack, wherein the at least one circuit includes a clock, wherein the at least one circuit is operative to cause the rechargeable battery pack to receive electricity delivered through the house current electrical connector responsive at least in part to a time determined responsive to the clock.

17. The apparatus according to claim 1 wherein the at least one electrical heating element only receives electrical power that originates from the rechargeable battery pack, wherein the at least one circuit includes a clock, wherein the at least one data store includes data corresponding to at least one time of day window, wherein electricity is provided to the house current electrical connector at a lower cost during times within the at least one time of day window, wherein the at least one circuit is operative to cause the rechargeable battery pack to receive electricity delivered through the house current electrical connector during at least one time corresponding to the at least one time of day window as determined responsive to the clock.

18. Apparatus comprising:

an on demand water heater including:

at least one electrical heating element, a heat exchanger, wherein the heat exchanger includes a heat exchanger water inlet and a heat exchanger water outlet, wherein the at least one electrical heating element is in thermal connection with the heat exchanger intermediate of the heat exchanger water inlet and the heat exchanger water outlet, wherein the heat exchanger water inlet is configured to be fluidly connected to a water source, and the heat exchanger water outlet is configured to be fluidly connected to at least one water use device, a water inlet temperature sensor, wherein the water inlet temperature sensor is operative to sense an inlet water temperature corresponding to temperature of water entering the heat exchanger water inlet, a water outlet temperature sensor, wherein the water outlet temperature sensor is operative to sense an outlet water temperature corresponding to temperature of water exiting from the heat exchanger water outlet, a flowmeter, wherein the flowmeter is operative to sense a water flow rate corresponding to rate of water flow passing through the heat exchanger, a house current electrical connector, wherein the house current electrical connector is configured to electrically connect to a source of house current electrical power, which source is limited to supplying house current electrical power at below a set power level, a rechargeable battery pack, at least one circuit, wherein the at least one circuit is in operative connection with at least one data store, wherein the at least one data store includes data corresponding to a set hot water delivery temperature, the at least one electrical heating element, the water inlet temperature sensor, the water outlet temperature sensor, the flowmeter, the rechargeable battery pack, the house current electrical connector, wherein the at least one circuit is operative to cause responsive at least in part to the water flow rate sensed by the flowmeter and the inlet water temperature sensed by the water inlet temperature sensor, electrical power to be delivered from the rechargeable battery pack to the at least one electrical heating element at a battery pack power delivery rate to cause the water outlet temperature to be at about the set hot water delivery temperature, wherein the battery pack power delivery rate is at least twice the set power level, the rechargeable battery pack to receive electrical power delivered through the house current electrical connector, wherein the electrical power delivered through the house current electrical connector is operative to charge the rechargeable battery pack, a water conditioner, wherein the water conditioner is fluidly intermediate of the water source and the heat exchanger inlet, wherein the water conditioner includes a valve, wherein the valve includes a plurality of flow passages, a motor, wherein the motor is in operative connection with the valve, wherein the motor is enabled to control the valve to cause the valve and liquid treatment tank to be selectively placed in a plurality of operational conditions, including a service condition wherein in the service condition water is delivered through the valve and caused to pass through the tank, and water treated by having passed through the tank is delivered from the valve, and a regeneration condition, wherein in the regeneration condition water is delivered through the valve and caused to pass through the tank which causes improvement of water treatment operation, and after having passed through the tank is delivered from the valve and to the heat exchanger inlet, a valve slave controller, wherein the valve slave controller is in operative connection with the motor, wherein the valve slave controller is operative to cause the motor to operate to change operational conditions of the valve and liquid treatment tank, a master controller, wherein the master controller is configurable to be operative to control a plurality of slave controllers, including the valve slave controller, wherein each slave controller includes a respective slave wireless communication portal, wherein the master controller includes a master wireless communication portal that enables the master controller to wirelessly communicate with each of the plurality of slave controllers, including the valve slave controller, wherein the master controller is operative to wirelessly communicate messages with the valve slave controller, which messages are operable to cause the valve slave controller to change at least one operational condition of at least one of the valve and the liquid treatment tank.

19. The apparatus according to claim 18 wherein the master controller and the valve slave controller are in operative connection with the rechargeable battery pack and are enabled to operate responsive to electricity supplied from the rechargeable battery pack.

20. The apparatus according to claim 18 a shut off condition, wherein in the shut off condition water is prevented from passing through the water conditioner to the heat exchanger inlet, wherein the master controller is operative to wirelessly communicate with a user portable wireless device, wherein the master controller is operative responsive to communication of at least one instruction message from the user portable wireless device, to change the at least one operational condition of at least one of the valve and liquid treatment tank, wherein each of the master controller and the valve slave controller are in operative connection with the rechargeable battery pack and are enabled to operate responsive to electricity supplied from the rechargeable battery pack.

21. Apparatus comprising:

an on demand water heater including:

a heat exchanger, wherein the heat exchanger includes a water inlet and a water outlet, at least one electrical heating element, wherein the at least one electrical heating element is in operative thermal connection with the heat exchanger, a flowmeter, wherein the flowmeter is operative to sense a water flow rate corresponding to water flow through the heat exchanger from the water inlet to the water outlet, at least one temperature sensor, wherein the at least one temperature sensor is operative to sense temperature corresponding to water temperature in at least one location in the heat exchanger, a rechargeable battery pack, a house current electrical connector, at least one circuit, wherein the at least one circuit is in operative connection with the flowmeter, the at least one temperature sensor, the rechargeable battery pack, the at least one electrical heating element and the house current electrical connector, wherein the at least one circuit is operative to cause responsive at least in part to the water flow rate and the at least one sensed temperature, electrical power produced by the rechargeable battery pack to be delivered to the at least one electrical heating element, whereby water passing through the heat exchanger is heated, electricity delivered through the house current electrical connector to be operative to cause charging of the rechargeable battery pack.

22. Apparatus comprising:

an on demand water heater including:

at least one electrical heating element, a heat exchanger, wherein the heat exchanger includes a heat exchanger water inlet and a heat exchanger water outlet, wherein the at least one electrical heating element is in thermal connection with the heat exchanger intermediate of the heat exchanger water inlet and the heat exchanger water outlet, wherein the heat exchanger water inlet is configured to be fluidly connected to a water source, and the heat exchanger water outlet is configured to be fluidly connected to at least one water use device, a water inlet temperature sensor, wherein the water inlet temperature sensor is operative to sense an inlet water temperature corresponding to temperature of water entering the heat exchanger water inlet, a water outlet temperature sensor, wherein the water outlet temperature sensor is operative to sense an outlet water temperature corresponding to temperature of water exiting from the heat exchanger water outlet, a flowmeter, wherein the flowmeter is operative to sense a water flow rate corresponding to water flow passing through the heat exchanger from the water inlet to the water outlet, a house current electrical connector, wherein the house current electrical connector is limited to supplying house current electrical power at no greater than a set power level, a rechargeable battery pack, at least one circuit, wherein the at least one circuit is in operative connection with at least one data store, wherein the at least one data store includes data corresponding to a set hot water delivery temperature, the at least one electrical heating element, the water inlet temperature sensor, the water outlet temperature sensor, the flowmeter, the rechargeable battery pack, the house current electrical connector, wherein the at least one circuit is operative to cause responsive at least in part to the water flow rate sensed by the flowmeter and the inlet water temperature sensed by the water inlet temperature sensor, electrical power to be delivered from the rechargeable battery pack to the at least one electrical heating element at a battery pack power delivery rate to cause the water outlet temperature to be at about the set hot water delivery temperature, wherein the electrical power is delivered from the rechargeable battery pack while the house current electrical connector is enabled to supply house current electrical power, wherein the battery pack power delivery rate is at least twice the set power level, the rechargeable battery pack to receive electrical power delivered through the house current electrical connector, wherein the electrical power delivered through the house current electrical connector is operative to charge the rechargeable battery pack.

23. Apparatus comprising:

an on demand water heater including:

a heat exchanger, wherein the heat exchanger includes a water inlet and a water outlet, at least one electrical heating element, wherein the at least one electrical heating element is in operative thermal connection with the heat exchanger, a flowmeter, wherein the flowmeter is operative to sense a water flow rate corresponding to water flow through the heat exchanger from the water inlet to the water outlet, at least one temperature sensor, wherein the at least one temperature sensor is operative to sense at least one temperature corresponding to water temperature in at least one location in the heat exchanger, a rechargeable battery pack, a house current electrical connector operative to deliver electricity, at least one circuit, wherein the at least one circuit is in operative connection with the flowmeter, the at least one temperature sensor, the rechargeable battery pack, the at least one electrical heating element and the house current electrical connector, wherein the at least one circuit is operative to cause responsive at least in part to the water flow rate and the at least one sensed temperature, electrical power produced by the rechargeable battery pack to be delivered to the at least one electrical heating element, whereby water passing through the heat exchanger is heated, wherein the electrical power produced by the rechargeable battery pack is delivered to the at least one electrical heating element while electricity is available through the house current electrical connector, electricity delivered through the house current electrical connector to be operative to cause the rechargeable battery pack to be charged.

24. Apparatus comprising:

an on demand water heater including:

at least one electrical heating element, a heat exchanger, wherein the heat exchanger includes a heat exchanger water inlet and a heat exchanger water outlet, wherein the at least one electrical heating element is in thermal connection with the heat exchanger intermediate of the heat exchanger water inlet and the heat exchanger water outlet, wherein the heat exchanger water inlet is configured to be fluidly connected to a water source, and the heat exchanger water outlet is configured to be fluidly connected to at least one water use device, a flowmeter, wherein the flowmeter is operative to sense a water flow rate corresponding to water flow through the heat exchanger from the water inlet to the water outlet, a water temperature sensor, wherein the water temperature sensor is operative to sense a water temperature corresponding to temperature of water currently delivered from the heat exchanger water outlet, a house current electrical connector, wherein the house current electrical connector is configured to electrically connect to a source of house current electrical power, which source is limited to supplying house current electrical power at no greater than a set power level, a rechargeable battery pack, at least one circuit, wherein the at least one circuit is in operative connection with at least one data store, wherein the at least one data store includes data corresponding to a set hot water delivery temperature, the at least one electrical heating element, the flowmeter, the water temperature sensor, the rechargeable battery pack, the house current electrical connector, wherein the at least one circuit is operative to cause responsive at least in part to the water temperature sensor and the water flow rate, electrical power to be delivered from the rechargeable battery pack to the at least one electrical heating element at a battery pack power delivery rate to cause water delivered at the heat exchanger water outlet to be at about the set hot water delivery temperature, wherein the electrical power is delivered from the rechargeable battery pack while the house current electrical connector is enabled to supply house current electrical power, wherein the battery pack power delivery rate is at least twice the set power level, the rechargeable battery pack to receive electrical power delivered through the house current electrical connector, wherein the electrical power delivered through the house current electrical connector is operative to charge the rechargeable battery pack.

25. Apparatus comprising:

an on demand water heater including:

a heat exchanger, wherein the heat exchanger includes a water inlet and a water outlet, at least one electrical heating element, wherein the at least one electrical heating element is in operative thermal connection with the heat exchanger, a flowmeter, wherein the flowmeter is operative to sense a water flow rate corresponding to water flow through the heat exchanger from the water inlet to the water outlet, at least one temperature sensor, wherein the at least one temperature sensor is operative to sense temperature of water currently delivered from the heat exchanger water outlet, a rechargeable battery pack, a house current electrical connector operative to supply electrical power, wherein the house current electrical connector is limited to supplying electrical power at or below a set power level, at least one circuit, wherein the at least one circuit is in operative connection with the at least one temperature sensor, the flowmeter, the rechargeable battery pack, the at least one electrical heating element and the house current electrical connector, wherein the at least one circuit is operative to cause responsive at least in part to the at least one temperature sensor and the water flow rate, electrical power produced by the rechargeable battery pack to be delivered to the at least one electrical heating element while electrical power from the house current electrical connector is available, whereby water passing through the heat exchanger is heated, wherein the power delivered to the at least one electrical heating element produced by the rechargeable battery pack is at least twice the set power level, electrical power delivered through the house current electrical connector to be operative to cause the rechargeable battery pack to be charged.

26. The apparatus according to claim 25 wherein the at least one circuit is in operative connection with at least one data store, wherein the at least one data store includes data corresponding to a set hot water delivery temperature, wherein the at least one circuit is further operative to cause water to be delivered from the water outlet at about the set hot water delivery temperature.

27. The apparatus according to claim 26 wherein the at least one temperature sensor includes a water inlet temperature sensor, wherein the water inlet temperature sensor is operative to sense an inlet water temperature corresponding to temperature of water entering the water inlet, a water outlet temperature sensor, wherein the water outlet temperature sensor is operative to sense an outlet water temperature corresponding to temperature of water exiting the water outlet, wherein the at least one circuit is operative to cause the water to be delivered from the water outlet at about the set hot water delivery temperature, responsive at least in part to the inlet water temperature and the outlet water temperature.

* * * * *